US006659013B1

(12) United States Patent
Kellner

(10) Patent No.: US 6,659,013 B1
(45) **Date of Patent: *Dec. 9, 2003**

(54) PROJECTILE OR WAR-HEAD

(75) Inventor: Gerd Kellner, Schramberg (DE)

(73) Assignee: futurec AG c/o Beeler + Beeler Treuhand AG, Rotkreuz (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/087,090

(22) Filed: May 29, 1998

Related U.S. Application Data

(63) Continuation of application No. PCT/CH97/00477, filed on Dec. 22, 1997.

(30) Foreign Application Priority Data

Jan. 8, 1997 (DE) ..... 197 00 349

(51) Int. Cl.[7] ..... F42B 12/04; F42B 12/34

(52) U.S. Cl. ..... 102/516; 102/364; 102/517; 102/518; 102/489; 102/491; 102/507

(58) Field of Search ..... 102/364, 374, 102/389, 343, 439, 489, 491, 493–497, 507–510, 514–519, 501, 503, 506, 473

(56) References Cited

U.S. PATENT DOCUMENTS

| | | | | | |
|---|---|---|---|---|---|
| 1,556,160 | A | * | 10/1925 | Riggs | 102/510 |
| 2,571,520 | A | * | 10/1951 | Barnes | 102/514 |
| 2,661,694 | A | | 12/1953 | Allen et al. | |
| 3,172,330 | A | * | 3/1965 | Lidmalm et al. | 102/393 |
| 3,302,570 | A | | 2/1967 | Marquardt | |
| 3,941,059 | A | | 3/1976 | Cobb | |
| 3,972,286 | A | * | 8/1976 | Canon | 102/507 |
| 4,172,407 | A | * | 10/1979 | Wentink | 102/489 |
| 4,353,302 | A | | 10/1982 | Strandli et al. | |

(List continued on next page.)

FOREIGN PATENT DOCUMENTS

| | | | | |
|---|---|---|---|---|
| DE | 3240310 A | | 6/1983 | |
| DE | 25 54 600 A | | 6/1988 | |
| DE | 52 364 C | | 7/1989 | |
| DE | 4007196 A | | 9/1991 | |
| DE | 40 24 543 A | | 2/1992 | |
| EP | 0 051 375 A | | 5/1982 | |
| EP | 0 531 697 A | | 3/1993 | |
| EP | 578981 | * | 1/1994 | 102/514 |
| GB | 887124 | * | 1/1962 | 102/517 |
| IT | 378355 | * | 6/1940 | 102/439 |
| JP | 406018200 | * | 1/1994 | 102/514 |
| RU | 1700349 | * | 12/1991 | 102/517 |
| WO | WO 90/00244 | * | 1/1990 | 102/518 |
| WO | WO 91 18227 A | | 11/1991 | |

*Primary Examiner*—Harold J. Tudor
(74) *Attorney, Agent, or Firm*—Scully, Scott, Murphy & Presser

(57) ABSTRACT

Projectiles or war-heads with an inner arrangement for the formation of bulging zones (4,4*a*) are proposed, comprised of an enclosed bulging medium (1) which is terminal-ballistically substantially ineffective and is radially enclosed by a penetration material (2) which is terminal-ballistically effective, with the bulging medium (1) having a lower density as compared with the enclosing penetration material (2). This leads to the effect that on impact or on penetrating a target plate (3) the bulging medium (1) remains behind relative to the encompassing terminal-ballistic effective body (2) and is laterally increasingly bulged by the bulging material (1) which continues to flow in from behind. As a result of the high pressures, a conical (crowned) pressure and bulging zone (4,4*a*) is formed dynamically, which zone radially widens or fragments the passing ambient effective material (5,5*a*).

4 Claims, 13 Drawing Sheets

U.S. PATENT DOCUMENTS 4,437,409 A 3/1984 Freymond
4,444,112 A 4/1984 Strandli et al.
4,522,356 A * 6/1985 Lair et al. ..... 102/489
4,597,333 A 7/1986 Böcker et al.
4,625,650 A * 12/1986 Bilsbury ..... 102/517
4,638,737 A * 1/1987 McIngvale ..... 102/518
4,649,829 A 3/1987 Bilsbury
4,671,181 A * 6/1987 Romer et al. ..... 102/518
4,703,696 A * 11/1987 Bocker ..... 102/517
4,708,064 A * 11/1987 Bisping et al. ..... 102/517
4,753,172 A * 6/1988 Katzmann et al. ..... 102/519
4,823,703 A * 4/1989 Donaldson ..... 102/518
4,913,054 A 4/1990 Petersen
4,970,960 A * 11/1990 Feldman ..... 102/517
5,157,225 A * 10/1992 Adams et al. ..... 102/493
5,291,833 A 3/1994 Boual
5,347,907 A * 9/1994 Strandli et al. ..... 102/518
5,349,907 A * 9/1994 Petrovich et al. ..... 102/506
5,365,853 A * 11/1994 Petrovich et al. ..... 102/514
5,445,079 A * 8/1995 Boual ..... 102/517

* cited by examiner

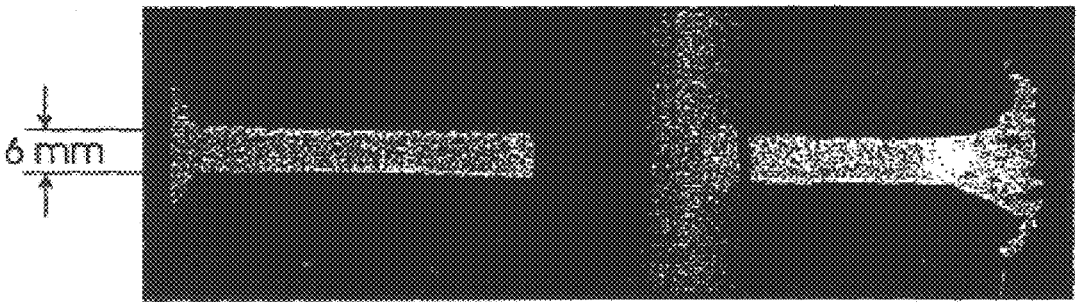
Fig. 16
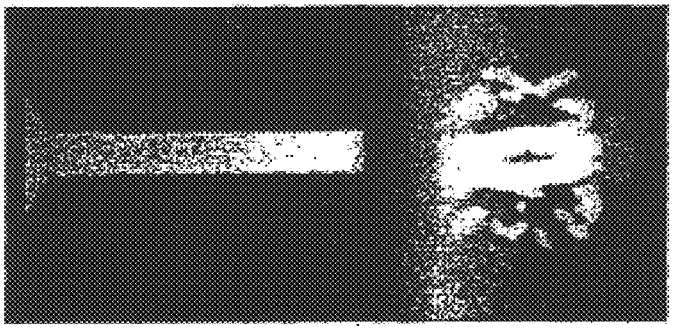
Fig. 17
Fig. 17A
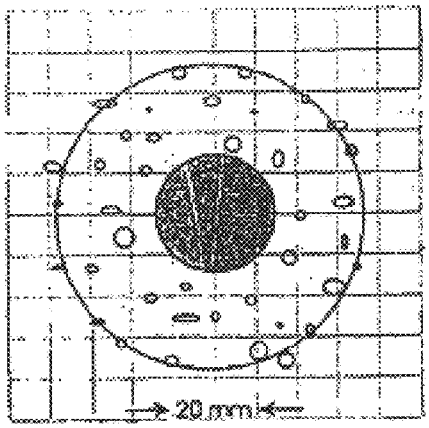

PROJECTILE OR WAR-HEAD

This application is a continuation of pending international application number PCT/CH97/00477, filed Dec. 22, 1997.

BACKGROUND OF THE INVENTION

The invention relates to projectiles or war-heads to fight targets, in particular armoured targets, with an inner arrangement for the dynamic formation of bulging zones and for achieving large lateral effects.

In a plurality of fields of application for projectiles and war-heads it is also desirable, in addition to the demanded penetrating power, to achieve the highest possible effect over area (lateral effect) for increasing the efficiency. This is required in particular in the case of projectiles against flying targets such as fixed wing aircraft, unarmoured helicopters or other aircraft, which from a terminal ballistic viewpoint belong to the as easier target classes.

In this field, however, so-called "hardened" objects appear increasingly, so that in addition to the high lateral effects partially also high penetrating powers are demanded. The same applies in a comparable way to other structures such as ships, for example. But also in respect of armour-piercing projectiles of high penetrating power, which must be achieved with increasingly slenderer and longer penetrators, securing a sufficient lateral effect during the target penetration or in the target interior is of increasing importance. These requirements apply both to cannon launched kinetic energy projectiles (kinetic energy projectiles) and to war-heads with kinetic energy effective bodies or so-called hybrid projectiles made from kinetic energy effective bodies and hollow charges.

Pursuant to German Pat. No. DE 25 54 600 C1 a solution is proposed, by means of which an improvement of the lateral effect of kinetic energy projectiles is achieved in such a way that by way of a forward core, which conically tapers in its rear end, the said conical end is delayed on impact and the subsequent penetration process and is pushed in between the prefabricated subprojectiles which are located in the rear, multipart core and accelerates the same radially either immediately or by way of a deformable transition piece. The function of this constructively sophisticated solution was proved both in spin-stabilized and aerodynamically stabilized projectiles (dart projectiles). However, the efficiency is particularly limited owing to the constructional requirements. Particularly where thin target structures are concerned they are not effective. Such solutions are very complex and thus cost intensive. All these factors strongly limit the application.

For the purpose of achieving increased lateral effects tests have been made with projectiles which on impact on a target either fall apart or scatter. These concern effective bodies with brittle steels or hard metals or brittle heavy metals, for example. Such approaches to solutions do not lead to very large splinter conical angles in comparison with the usual penetrators. The possibilities concerning construction and materials are strongly limited in this case too. Moreover, such solutions are preferably suitable for spin-stabilized projectiles only. Moreover, the penetrating power of such projectiles decreases drastically, so that they are only useful for a limited spectrum of applications. Such solutions are particularly less efficient in the case of thinner targets, which also applies to structured targets (multi-plate targets).

In European Pat. No. EP 0 343 389 A1 the projectile core of a discarding sabot projectile is described which consists of a relatively brittle central portion of the projectile core in which a relatively ductile projectile core pin is inserted which is anchored at its rear end in the rear part of the projectile core and at its front end in a tip of the projectile core. For the brittle middle portion of the projectile core frangible tungsten is preferably proposed, whereas the projectile core pin consists of a ductile tungsten, hard metal or any other terminal-ballistically effective material. The relatively brittle middle portion of the projectile core already disintegrates during the penetration of the first target plate of a multi-layer armour-plating, whereas the ductile projectile core pin does not fragment during the penetration process, but instead successively penetrates the following target plates and thus degrades continuously in its length and mass. The relatively thin and thus low-mass projectile element is particularly not suitable for achieving a larger depth effect or for penetrating deeper targets with a continuous lateral effect. The densities of the brittle middle portion of the projectile core and the ductile projectile core pin are nearly the same. A high lateral effect of the splinters in combination with a penetration of multi-layer target plates is thus not given.

WO 92/15836 A1 discloses a spin-stabilized armour-piercing splinter-producing projectile which is formed from a projectile case with a material of high density and a forward head element of the same material in which the disintegration of the projectile case occurs mechanically with the help of a pretensioned heavy material which is located in a pocket hole in the rear part of the projectile casing and a groove in the case structure. Tungsten powder is proposed as compressed filling material. This solution is as ineffective in thin targets as in deep targets. It is also impossible to achieve a terminal-ballistically effective compression in a constructional manner owing to the powdery filling material.

European Pat. No. EP 0 238 818 A1 describes a spin-stabilized discarding sabot projectile which consists of a hollow fragment casing which is closed at the back and front and a projectile tip attached thereto. An inert powder with a density of not less than 10 g/cm3 is proposed. The fragment casing is provided with predetermined breaking points which determine the size of the individual splinters. The fragment casing is to fragment after the penetration of the projectile and break down into individual effective splinters. The powdery filling made from tungsten is ejected after the penetration owing to the rotation of the projectile. A high lateral and, simultaneously, high-depth effect cannot be achieved with such a concept, as the invention is based primarily on the centrifugal forces of a spin projectile and despite prefragmentation the tungsten powder will not sufficiently break down the encompassing thick jacket in the radial direction owing to the natural hollow spaces. Moreover, the powder filling is intended as a replacement for the bursting and burning charge, with the high density being intended to directly produce terminal ballistic effects.

A further fragmentation principle for achieving a lateral effect is proposed in the specification (JP 08061898) in which a reactive metal is arranged in a metal cylinder which reacts chemically thermally with air and water when the armour-piercing ammunition collides with an object. It is obviously intended in this case to produce a "quasi" explosion and burning effect by the special reaction of the metal so as to achieve a strong radial destructive force.

A non-armour-piercing method to achieve an increased lateral effect with a projectile after the impact on or penetration of a target is known from German Pat. No. DE 28 39 372 A1, in which a projectile is proposed for hunting purposes which consists of a massive projectile casing which is provided with a central pocket hole extending from the front to the rear in which a filling, preferably made from lead, with cavities is introduced. In this design the heavier material is located in the interior of the ambient casing and causes a mushrooming of the forward projectile part during the penetration of the soft target body. In this way the projectile is enabled to transmit its energy to the body of the hunted game in an intended manner and achieve a higher spreading effect. A lateral fragmentation of the projectile body or a lateral splintering effect is not intended, yet it is even undesirable. A similar effect is achieved with the prohibited dum-dum principle against persons.

With respect to solutions provided for armour-piercing projectiles with high penetration power which must be achieved with increasingly slenderer and longer penetrators, few inventions are known whose subject matter is the achievement of a sufficient lateral effect. Usually, the objective of such projectile designs is solely the achievement of a large depth power.

German Pat. No. DE 40 07 196 A1 describes a hyperspeed kinetic energy projectile with a carrying outer casing which encloses a mass body of heavy bulk material, preferably tungsten and depleted uranium powder. In this invention the casing is merely used for the stability of the insert consisting of the heavy metal powder during the launch acceleration and the flying phase. The projectile, which is impacted on the target at a very high speed, achieves its high depth effect because in the hyper speed range the strength of the material of the penetrator no longer or only hardly influences the penetration power. At lower speeds the depth power thus decreases strongly. The lateral effect is marginally low. These projectiles are known as so-called segmented penetrators.

In U.S. Pat. No. 5,440,995 a heavy metal penetrator is presented which is composed of tungsten whiskers. In the case of common penetrators made from polycrystalline tungsten heavy metal, a plastic or hydrodynamic head (mushroom) forms during the penetration of an armoured target, which head influences or reduces the penetrating depth power. The proposed penetrator concept is to prevent this formation of head and thus to increase the depth power. The principle is therefore solely aimed at the achievement of the highest possible depth power. A lateral effect is not given.

A subcaliber kinetic energy projectile with a high length/diameter ratio and a hybrid arrangement is disclosed in European Pat. No. EP 0 111 712 A1 which substantially consists of a main, intermediate and tip body. The intermediate body, consisting of a brittle sintered material of high density such as tungsten or depleted uranium, is connected in a plane abutting joint area on the rear side with the main body and on the front side with the tip body also in a plane abutting joint area, with both the main body and the tip body being formed from a tenacious sintered material of high density such as the aforementioned metallic materials. On impact on an armoured target the particles formed from the brittle material of the intermediate body are to widen the penetration crater and cause a strong blasting effect after the first target plate. Such free buffer layers principally act both in a pressure- and performance-reducing way. The splintering effect remains limited both locally as well as laterally owing to the design and the low differences in density between the brittle and tenacious sintered materials, as the brittle intermediate body is compressed on impact in the axial direction by the tip and main body and, together with these two ballistically highly effective masses, is driven purely axially through the penetration crater.

A further development of the invention as discussed above according to European Pat. No. EP 0 111 712 A1 is described in German Pat. No. DE 33 39 078 A1 in which the connection between the brittle intermediate body of high density and the ductile main body of also high density, or same density, or even the brittle intermediate body per se is stabilized by a high-strength thin casing. Although this causes an improvement of the stability of the kinetic energy projectile during the launching or flying phase, it does not change however, anything with respect to the terminal ballistic effect as compared with the invention pursuant European Pat. No. EP 0 111 712 A1.

From the state of the art as discussed above one can derive that to date practically no solutions, and particularly no simple ones, are known for an armour-piercing projectile where a high lateral effect is achieved in different targets in conjunction with an adequate depth effect.

It is further known that by using glass bodies which are enclosed under high pressure during impact and penetration of projectiles it is possible to achieve increased lateral effects. These effects are caused by the special dynamic behaviour of glass which has been used for decades in the area of the protection of armour against hollow charges. Accordingly, the use of glass by way of a so-called "crater breakdown" leads to an influence on the stream during the penetration and thus to a considerable reduction of the penetration depth.

Any application of brittle materials such as glass or ceramics as dynamically acting medium is naturally subject to considerable limitations concerning the production techniques for the projectiles and, optionally, warheads and concerning the transmission of forces such as during the acceleration phase of the projectiles and warheads for example. The technical problems in the introduction of glass into the respective hollow spaces of a projectile body are an example. In prefabricated glass bodies the constructional possibilities for use are strongly limited. Moreover, the arrangement of the contact surfaces with the ambient (enveloping) bodies requires considerable technical efforts. Moreover, glass and ceramics are limited to a certain density range.

In the case of the introduction of glass by way of casting, which means that ceramic materials can principally be omitted owing to the required extremely high sintering temperatures, tensions in the glass body per se would have to be expected by the cooling process even if a perfect casting could be achieved. These tensions may in some cases also have a negative effect on the ambient bodies. Moreover, as was already mentioned above, contact problems would arise on the transition surfaces between the medium and the parts enclosing this medium. But even during the melting of glass temperatures occur which in many cases would lead to impermissible changes in the ambient materials. Moreover, in the use of these fragile and impact-sensitive materials as a dynamically active medium it is not necessary, with the principal exception of pure pressure forces (primarily in the sense of a polydirectional or hydrostatic pressure), to transmit any technical stresses, and thus forces (tension and shearing forces), worth mentioning.

Moreover, in the Germano-French Institute (hereinafter referred to as "ISL") experiments with provided glass fibre reinforced plastic materials were performed. It was intended to test primarily whether glass could be replaced as the bearer of the effect and whether in the case of a positive answer to this question it could be assumed, analogously to the protected technology, that the glass content (resin content) or the hardness of the glass fibre reinforced plastic material, for example, are relevant for the operativeness and that consequently with specially highly filled assortments it is possible to achieve a fragmentation factor comparable to pure glass. It is was also proposed to principally verify the previously presumed "glass effect" by changing the resin content.

The experiments confirmed that with glass fibre reinforced materials with a high share of glass (a share of approx. 80% by weight) terminal ballistic effects can be achieved which correspond to those of pure glass as working medium. These first experiments led to the result, however, that with materials which comprise a considerably lower share of glass it is possible to achieve in a surprising manner respective or even considerably higher lateral effects. The thus resulting further considerations and the experiments thus additionally proposed to the ISL and performed there led to the finding that the effects originally described in connection with glass are obviously not so relevant for the increased lateral effects observed in this connection.

According to the latest findings it is important to introduce into a body with terminal ballistic effect or into a casing made from a material which has a terminal ballistic effect a "bulging medium" (hereinafter referred to as AWM) which shows little compressibility and comprises a comparably low density or terminal ballistic power in comparison with the actual effective bodies. The same naturally also applies in the case that the AWM is located between an outer body with terminal ballistic efficiency and a central penetrator.

The terminal ballistic power of an effective body is determined in the range of lower impact speeds (below 1000 m/s) by its mechanical properties and its density, and in the upper speed range (more than 1000 m/s) increasingly by its density.

In the doctoral thesis "Das Verhalten von Kupferstiften beim Auftreffen auf verschiedene Werkstoffe mit Geschwindigkeiten zwischen 50 m/s und 1650 m/s (The behaviour of copper pins on impact on various materials at speeds between 50 m/s and 1650 m/s)" by Dipl.-Ing. Günter Weihrauch of Feb. 12, 1971 of the University (TH) Karlsruhe and in the ISL report with the same name a number of things are said about this behaviour on pages 98 to 101. The following pressure balance arises in a co-ordinate system which is moved along with the stagnation point:

$$\tfrac{1}{2}\rho_p{}^*(v-u)^2=\tfrac{1}{2}\rho_z{}^*u^2+F$$

with v=projectile speed, u=penetration speed, $\rho_p$=density of the projectile material, $\rho_z$=density of target material, F=factor which is changeable with the bulging speed of the bulging zone and depends both on the dynamic tenacity of the target and of the projectile material and thus also of the AWM.

Accordingly, the influences arising from the compressibility of the material and the dissemination speeds of the elastic and plastic faults are also included by way of term F. At higher speeds v of the projectile the share of F decreases and the known Bernoulli's equation applies with sufficient accuracy:

$$\tfrac{1}{2}\rho_p{}^*(v-u)^2=\tfrac{1}{2}\rho_z{}^*u^2$$

From this equation one receives for the penetration speed u, which also known as crater base speed, a term where the speed u only depends on the projectile speed v and the material densities $\rho_z$ and $\rho_p$:

$$u=v/(1+\sqrt{(\rho_z/\rho_p)}).$$

If the projectile does not consist of a uniform material, this term applies under the prerequisite of high projectile speed v for every single material in the projectile, with the respective material density such as $\rho_{AWM}$ or $\rho_{Casing}$ having to be inserted for $\rho_p$.

It can easily be derived therefrom that materials with lower density than the actual penetrator material with high terminal ballistic power will achieve lower penetration speeds at high projectile speeds and thus will remain behind in the target as compared with the ballistically highly effective penetration material.

At relatively low projectile speeds F becomes a speed term on an equal standing, i.e. the dynamic strengths of the materials involved are co-decisive. For the achievement of rapidly commencing and high lateral effects, materials with low strength should be used as bulging medium. Concerning the density one still has a relatively large amount of leeway.

Accordingly, at high projectile speeds (more than 1000 m/s) one can vary the density of the AWM, because then the mechanical properties do not play any major role any more.

At very high speeds (1500 m/s up to several km/s) one can usually entirely neglect the dimensional stability of projectile and target material, so that the strength of the materials involved does not play any role any more. In this case metallic and other materials can be treated approximately as liquids.

The speed from which the strength of the matter can be ignored depends, however, strongly on the respective properties of the material. Accordingly, these impact phenomena from the high-speed range already occur at relatively low speeds when dense and simultaneously dynamically soft materials such as lead, copper or tantalum are involved.

These considerations show that the effectiveness of the arrangements as proposed here is not limited to a specific speed range, but is present both from relatively low impact speeds (some 100 m/s), as occur at large fighting distances for example, right up to very high impact speeds in the magnitude of several km/s, as occur for example in impact situations with so-called tactical missiles (TBM defence).

In line with the above considerations it is necessary to influence the dynamics of the inner bulging zone in projectiles and war-heads over wide limits and with very simple means.

SUMMARY OF THE INVENTION

It is therefore an object of the present invention to arrange projectiles and war-heads with simple means in such a way that the same can both achieve a strong lateral effect and simultaneously ensure high penetration depths if required.

This object, and others which will become apparent hereinafter, is attained in accordance with the present invention by radially encompassing a bulging medium in the form of a material which is substantially terminal-ballistically ineffective by an outer body in the form of a penetration material which is considerably more terminal-ballistically effective.

Further features, details and advantages arise from the description below in conjunction with the claims and the individual figures.

BRIEF DESCRIPTION OF THE DRAWING

The above and other objects, features and advantages of the present invention will now be described in more detail with reference to the accompanying drawing in which:

FIG. 16 shows an X-ray flash photograph of a further experiment with glass fibre reinforced plastic material as a bulging medium and a thinner first target plate;

FIG. 17 shows an X-ray flash photograph of a further experiment with glass fibre reinforced plastic material as a bulging medium pursuant to FIG. 9 and a low impact speed (<1000 m/s);

FIG. 17A shows the splinter picture, represented on a grid, of the experiment pursuant to FIG. 17;

DETAILED DESCRIPTION OF PREFERRED EMBODIMENTS

Figure 1:
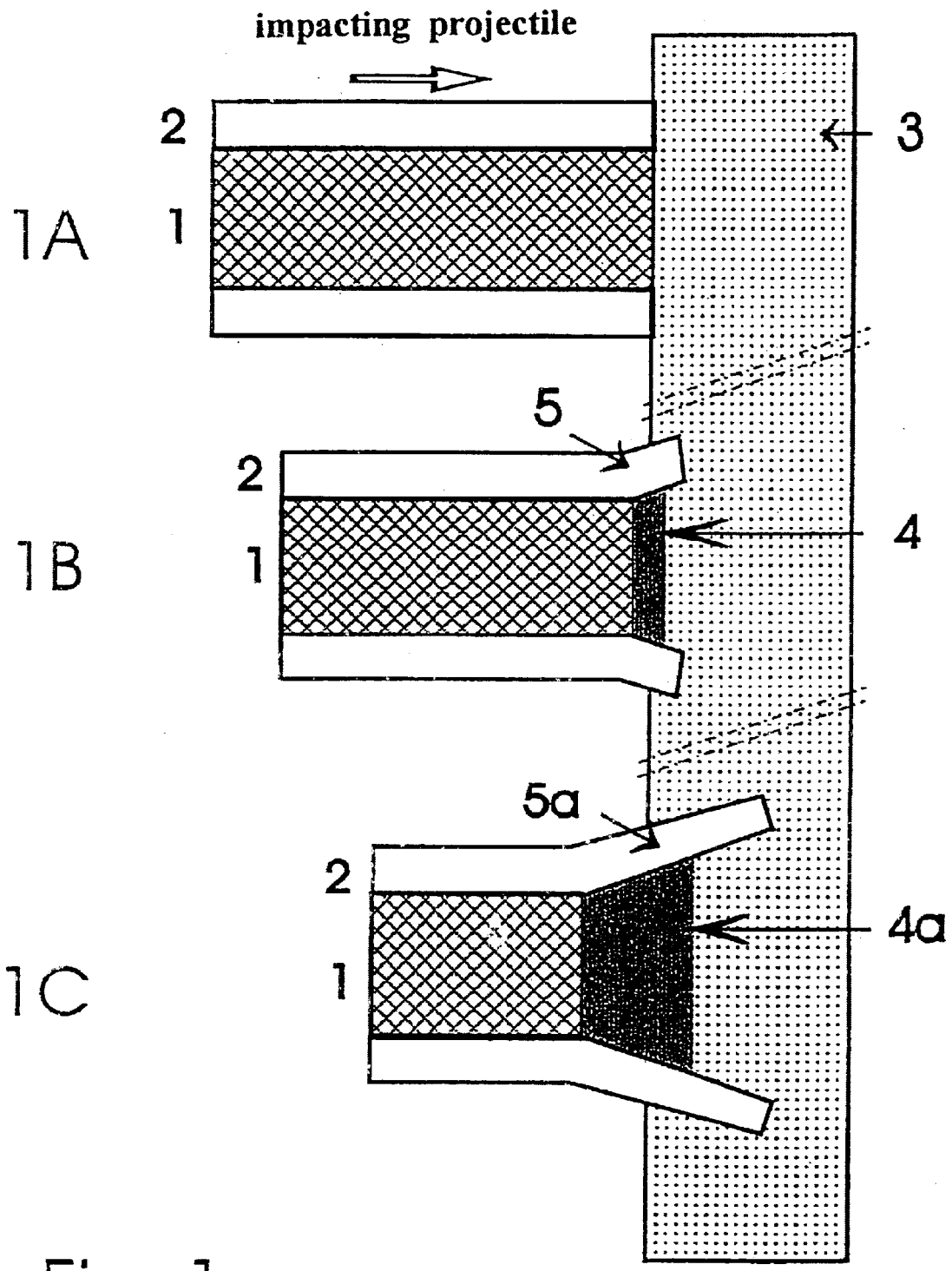
FIGS. 1A–1C show in three different phases a principal representation of the penetration and bulging process in accordance with the invention.

The sequence of the penetration and bulging process in accordance with the invention is shown in a principal and schematic manner in FIG. 1

Owing to its specific properties, the inner and enclosed bulging medium (AWM) 1 remains behind relative to the ambient terminal ballistic effective body 2 during the piercing and penetration. Owing to its compressibility, which is also limited under the high occurring pressures, a lateral flattening and thus a dynamic bulging of the ambient material 2 occurs through the material of the bulging material 1 which continues to flow from behind.

This process is determined by the physical and mechanical properties of the involved materials 1 and 2. The dynamic bulging usually leads to a tearing open or fragmentation of the outer body (casing) 2. In conjunction with its mechanical properties, dimensions, its density and speed (pass-by speed), an angular range arises in which the arising partial penetrators or splinters move.

FIG. 1 shows the three penetration statuses 1A, 1B and 1C, with 1A showing a first phase, 1B a second phase and 1C a third phase of the process. In the section 1A the projectile consisting of a bulging medium 1 and a terminal-ballistically effective casing 2 is currently impacting on the target plate 3. In the representation 1B a pressure zone 4 has built up through the reduced penetration of the bulging medium 1 into the target material 3. This leads to a bulging and deflection zone 5 of the casing which is passing by. This process has continued further in representation 1C. The pressure and bulging zone 4*a* has widened and remains behind the passing casing in an increasingly stronger way. The deflected or bulging zone 5*a* increases in a respective manner.

Figure 2:
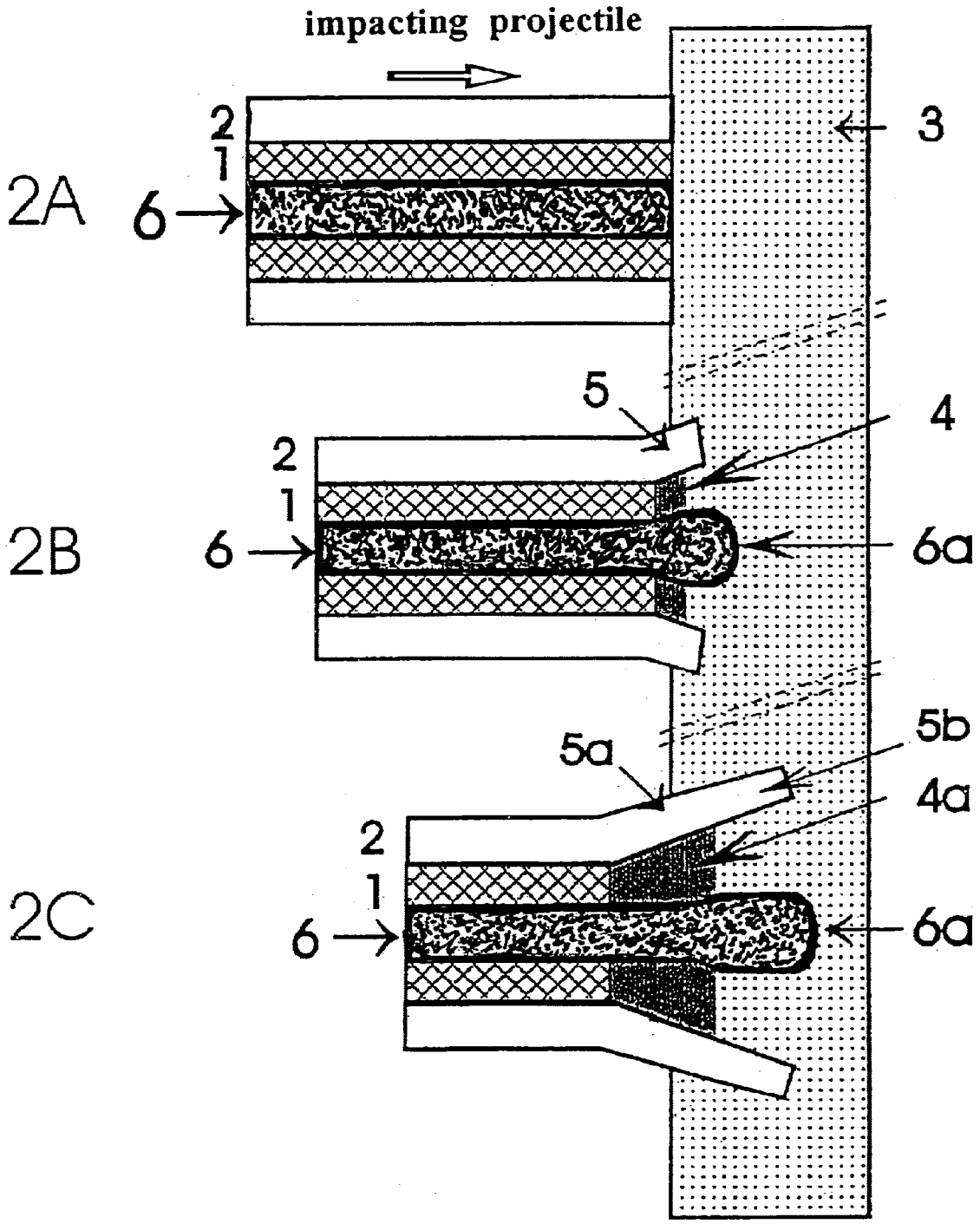
FIGS. 2A–2C show in three different phases a principal representation of the penetration and bulging process in accordance with the invention with an additional central penetrator.

FIG. 2 shows the process pursuant to FIG. 1 with a projectile in which a central penetrator 6 is additionally provided. Here too three different penetration statuses 2A, 2B and 2C are shown with respect to different penetration times. At the time 2B the pressure and bulging zone 4 has formed between the passing casing 2, which is bulged or deflected in the deformation zone 5, and the central penetrator 6 which also penetrates more rapidly and usually comprises at higher impact speeds a plastic or hydrodynamic head 6*a*. Section 2C shows this process in an even later status. The pressure and bulging zone 4*a* is enlarged and the casing 2 is further deformed via the deflection zone 5*a*. Owing to its new direction of movement, the deflected zone 5*b* penetrates the target plate 3 with a considerably increased radial component.

Figure 3:
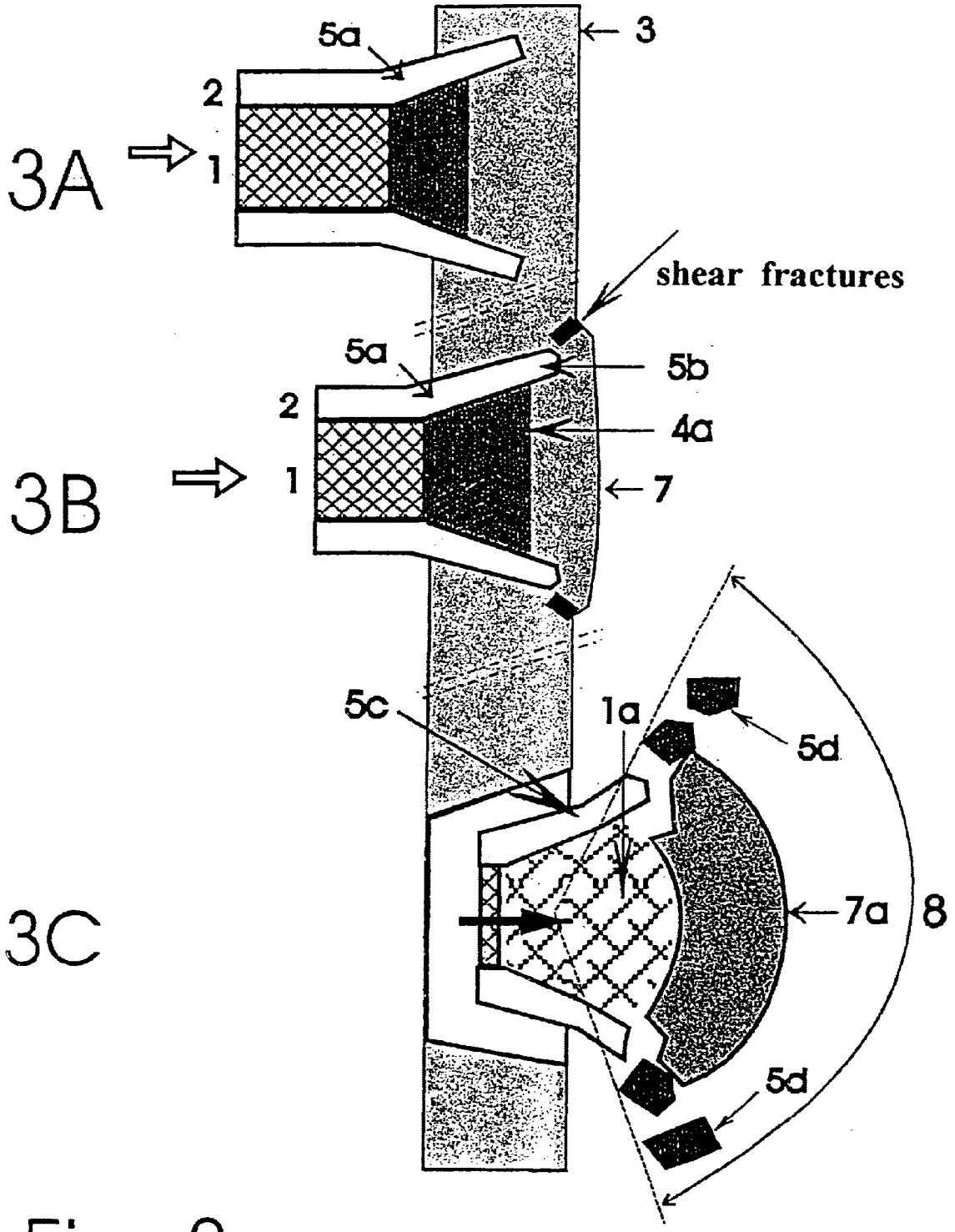
FIGS. 3A–3C show in three different phases a principal representation of the penetration process and the lateral production of splinters.

FIG. 3 describes in section 3A, 3B and 3C the effects caused by the projectile pursuant to FIG. 1 in the zone of the exit crater in the target plate 3. The section 3A corresponds to the section 1C of FIG. 1. At the time or position 3B, following the formation of shear fractures, a blow-out zone 7 begins to form which owing to the described high lateral effects during the penetration is considerably larger than is the case with common kinetic energy projectiles. As a result of the simultaneously occurring relief from the rear side of the plate, the pressure zone 4*a* of the bulging medium is relieved. The relieved material 1*a* exits behind the blow-out zone 7 from the crater (section 3C), followed by the residual projectile 5*c*. As a result of the detaching exit crater zone 7*a* which exits with increasing acceleration and a further relief, there is usually also a fragmentation of the bulged penetrator zone (casing zone) 5*b* from the residual projectile 5*c*, so that casing splinters 5*d* form. Owing to their higher speed, they slide off from the target area 7*a* which exits at a still relatively low speed. In this process they are further deflected radially. This causes an additional enlargement of the exit angle 8 of the splinters 5*d*.

Figure 4:
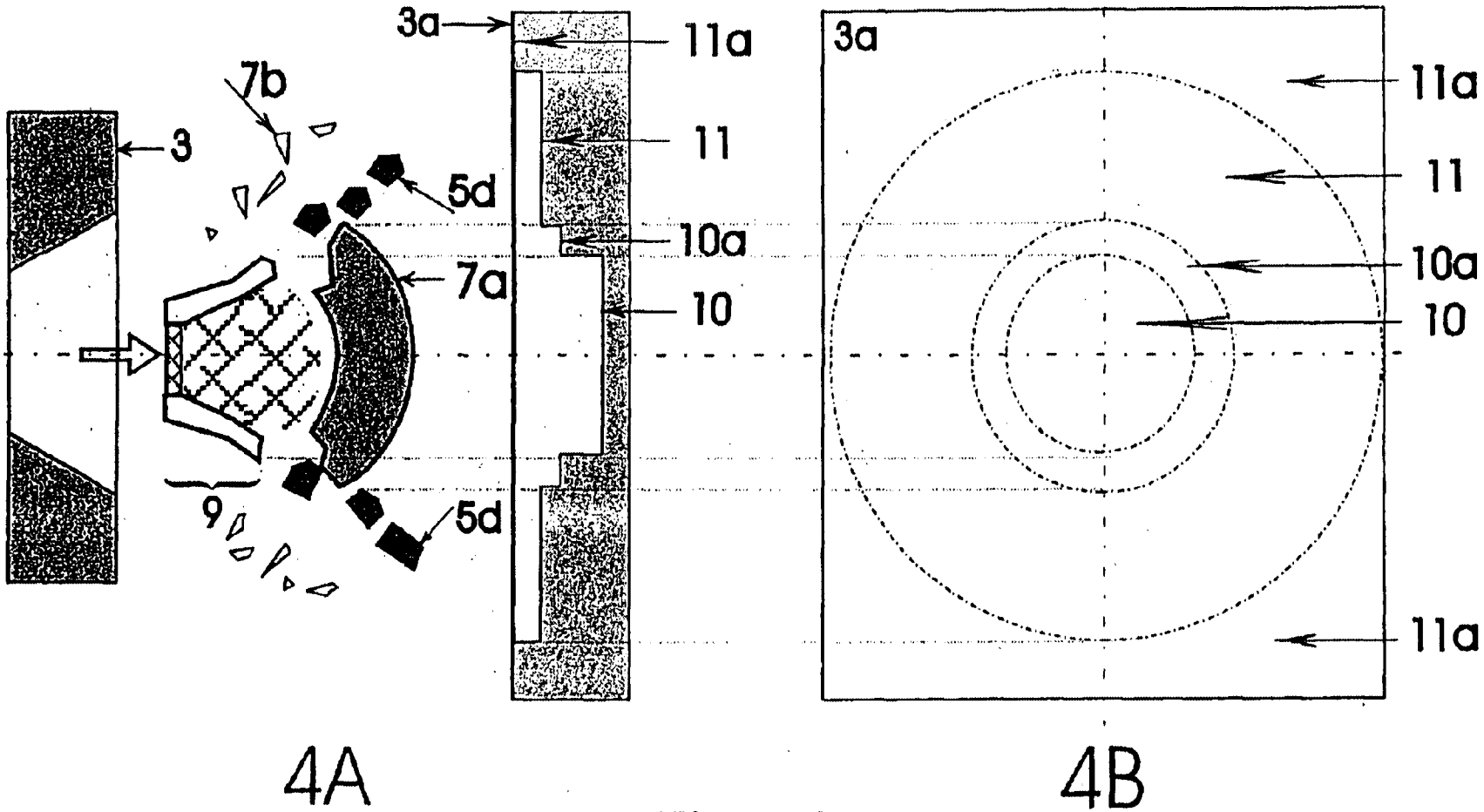
FIGS. 4A–4B show a principal representation of the process in accordance with the invention for a two-plate target.

FIG. 4 describes the process according to FIG. 1 and FIG. 3 in an examplary manner in a two-plate target.

Once a crater was formed in the first plate 3 (section 4*a*), whose size arises substantially from the projectile parameters (structure, materials, dimensions, impact speed) and the target plate data (material, thickness, mechanical properties), the residual projectile 9 which remains after the formation of the casing splinters 5*d*, the extracted crater zone 7*a* and the splinters 5*d* of the bulged partial zone of the casing impinge upon the second plate 3*a*. Section 4B shows a view onto the impacted second plate 3*a*. Different crater zones arise: The impact zone 10 which is formed by the residual projectile 9 and the central part of the exit zone 7*a*, crater 10*a* which is caused by the outer part of the exit zone 7*a*, and the zone of the splinters 11 which is produced by the casing splinters 5*d*. Further outside is the zone 11*a* of the splinters 7*b* extracted from the target material 3.

Usually, the outer crater zones in particular will overlap more or less strongly depending on the physical and technical conditions.

Figure 5:
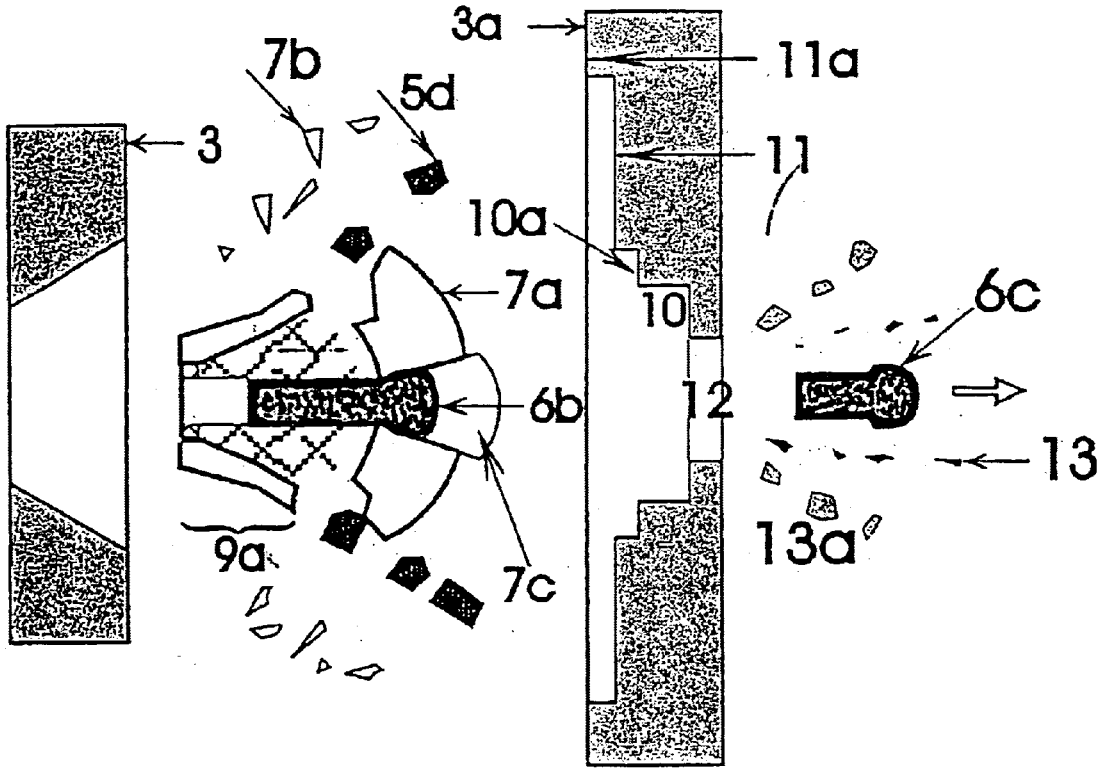
FIG. 5 shows a principal representation of the process in accordance with the invention for an arrangement with a central penetrator and the full penetration through a two-plate target.

When adding further target plates the above descriptions apply analogously. FIG. 5 shows the case where a projectile with a central penetrator 6 according to FIG. 2 penetrates a two-plate target according to FIG. 4. On penetrating the first plate 3 the descriptions as made in connection with image 4A apply, extended by the central penetrator 6 or the penetrating penetrator head 6*a*. Thereafter the residual penetrator 6*b* penetrates the extracted crater zone 7*a* and forms a further breakthrough 7*c*. The thickness of the second plate 3*a* was chosen in such a way that it is still penetrated by the central residual penetrator 6*b*. Only the respectively shortened residual penetrator 6*c* exits after the second plate, encompassed by a splinter cone made of penetrator parts 13 and target splinters 13*a* which have formed from the breakthrough 7*c* or were extracted from the second target plate 3*a*. This target zone thus corresponds to the usual penetration image of a kinetic energy projectile with a bulging medium.

A section through the second plate 3*a* shows the different crater zones. At first the inner crater zone 12, formed by the residual penetrator 6*b* and the breakthrough 7*c*, followed by the zone 10 which is formed by the residual projectile without a central penetrator 9*a*. A crater zone 10*a* follows which is produced by the extracted crater zone 7*a*. This is followed by a crater zone 11 produced by the splinters 5*d* of the fragmented partial zone of the casing. Further outside there is located a crater zone 11*a* which is formed by the extracted target splinters 7*b* of the first plate 3.

These considerations lead to the conclusion that in the projectile design as described herein an introduced central penetrator 6 is virtually not impaired in its terminal ballistic power. Accordingly, its penetration depth corresponds to the performance as achieved by such massive penetrators alone.

This applies analogously with respective dimensionings also for penetrators which are introduced at other positions in the bulging medium (preferably in the vicinity of the axes). At the same time this finding explains how in the case of armour-piercing ammunition a respectively high basic penetration power is to be combined with the large lateral effects as described herein.

Figure 6:
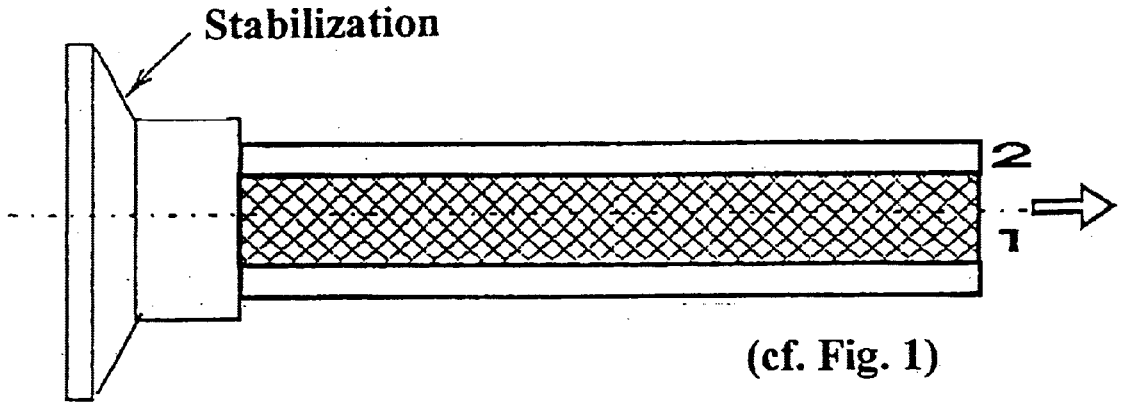
FIG. 6 shows a principal representation of the experimental model projectile.

As was already mentioned above, experiments with model projectiles according to FIG. 6 were performed according to the considerations as explained above. The projectiles consisted pursuant to FIG. 1 of a casing made from tungsten heavy metal (tungsten heavy metal; length 40 mm, outer diameter 6 mm, inner diameter 3.5 mm, density 17.6 g/cm$^3$) which enclosed the introduced bulging medium of the same length (diameter 3.5 mm). The rear was formed by a base plate for aerodynamic stabilization.

FIG. 7 to FIG. 11 and FIG. 16 to FIG. 17 show X-ray flash photographs of the experiments. All illustrations concern two X-ray flash photographs each at to different times. The left representation shows the impacting projectile (in all graphics and illustrations the projectile flies from the left to the right side), the right one shows the respective deformation condition at the time of the photograph. Both relatively thick one-plate targets (FIG. 7) as well as two-plate targets (FIG. 8 to FIG. 11 and FIG. 16 to FIG. 17) were shot at.

Figure 7:
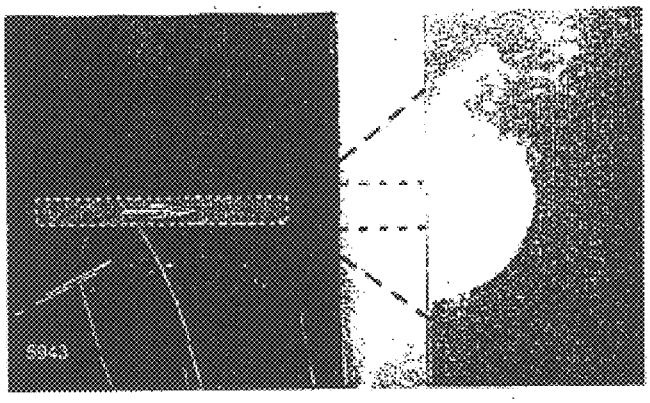
FIG. 7 shows an X-ray flash photograph of an experiment with glass fibre reinforced plastic material as a bulging medium (AWM)

FIG. 7 shows the X-ray flash photograph of an experiment with a homogeneous target plate 3 made from armour steel (strength approx. 1000 N/mm$^2$) of a thickness of 25 mm. The bulging medium 1 consisted of a glass fibre reinforced plastic material with a density of 1.85 g/cm$^3$. The crater contours are entered as broken lines, as is the crater in dotted lines which is caused by respective comparison experiments of massive heavy metal penetrators of the same outer diameter. The crater diameters of the casing 2 consisting of tungsten heavy metal without a bulging medium 1 are comparable to this.

The right section shows a previously unknown, enormous enlargement of the produced crater, and thus also an enlargement of the exiting splinter cone, formed by projectile and target splinters.

This allowed providing experimental evidence that in the case of massive target plates there is a perfect function of the bulging medium within the terms as described herein (according to FIG. 1). The lateral effect was a multiple of all previously known results. In these experiments, for example, a crater volume of approximately 5 times more was achieved as compared with the firing with a massive penetrator made from tungsten heavy metal of the same outside diameter or a tungsten heavy metal casing of the same mass without a bulging medium.

Respective results were also achieved with other bulging media such as copper, aluminium and polyethylene in the speed range between 1000 m/s and 1800 m/s.

The experiments in connection with FIG. 8 to FIG. 11 were made to provide evidence that both a relatively weak first plate 3 with simultaneous low density and thus low specific surface mass causes the full lateral effect and that in this case different materials other than the bulging material 1 can be used according to the above statements.

A two-plate arrangement according to FIG. 4 was used as a target, with a first plate 3 made from duraluminium of a strength of 400 N/mm$^2$ and a thickness of 12 mm and a second plate 3*a* made from armour steel and erected at a distance of 80 mm. The impact speed in these experiments was between 1400 and 1800 m/s. The projectile structure corresponded to the structure according to FIG. 6. The bulging medium 1 was varied, with the density being assumed as main parameter according to the high impact speeds.

Figure 8:
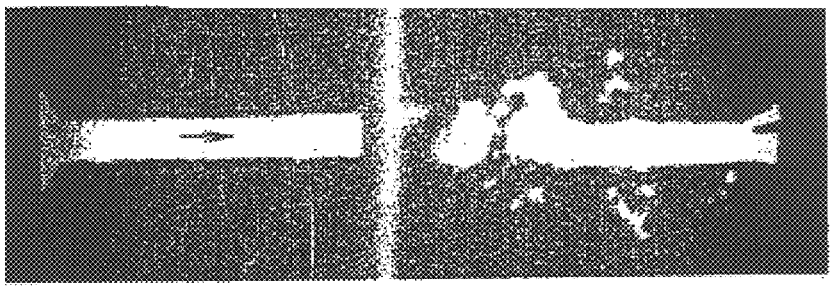
FIG. 8 shows an X-ray flash photograph of an experiment with a hollow model projectile without bulging medium.

FIG. 8 shows at first the comparison experiment with a hollow penetrator (i.e. without a bulging medium) made from tungsten heavy metal with the same outer diameter. As a result of the relatively light target plate, virtually no plastic head has formed. With the exception of a small extract on the right side of the X-ray flash photograph, one cannot recognize any lateral deformation.

Figure 9:
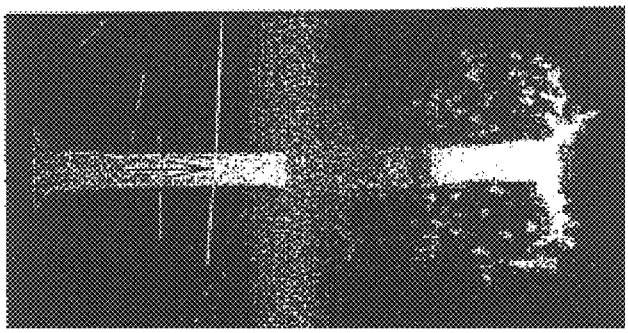
FIG. 9 shows an X-ray flash photograph of a further experiment with a glass fibre reinforced plastic material as a bulging medium.

The glass fibre reinforced plastic material that was already used in the experiment pursuant to FIG. 7 is used as bulging medium in the experiment in connection with FIG. 9. The lateral fragmentation occurs to the full extent.

Figure 10:
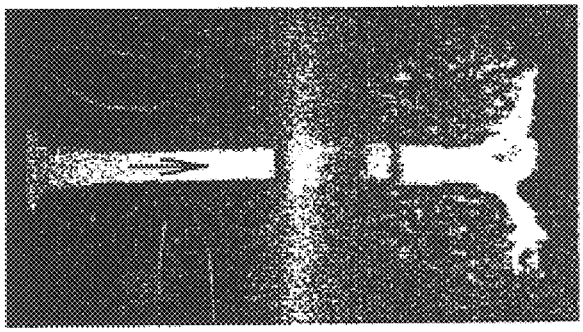
FIG. 10 shows an X-ray flash photograph of a further experiment with aluminium as a bulging medium.

FIG. 10 shows an experiment with aluminium as a bulging medium. The lateral fragmentation occurs according to the explanations made above, but surprisingly more markedly.

Figure 11:
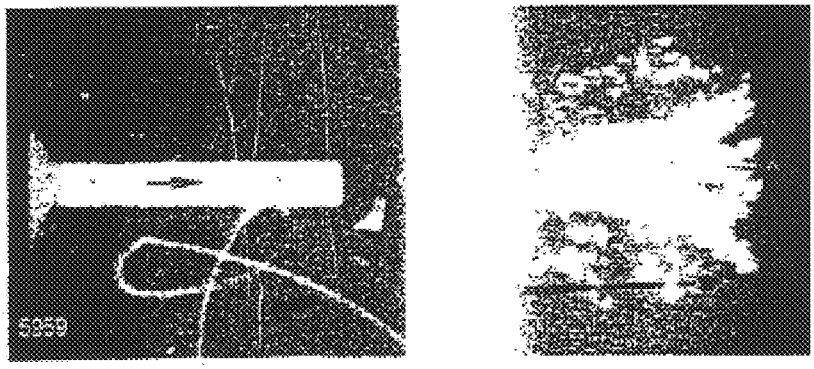
FIG. 11 shows an X-ray flash photograph of a further experiment with a bulging medium of particularly low density (PE)

In FIG. 11 polyethylene (PE) was used as bulging medium. In this material with a very low density, but with a sufficiently low dynamic compressibility and relatively large shock hardness, there is a very marked lateral fragmentation.

These X-ray flash photographs confirm that even in the case of perfect lateral accelaration there are considerable differences in the behaviour of the various bulging media.

Accordingly, in the case of PE as bulging medium with a particularly low density (FIG. 11) the entire heavy metal casing is slit open over the entire length of the projectile through the first plate for example, with the lateral accelaration of the formed segments (subpenetrators) occuring continuously from the tip to the rear (cf. FIG. 11, right side). In the case of aluminium as a bulging medium (FIG. 10) there is an even stronger lateral effect under the prerequisites which apply to this experiment. However, only half of the projectile length is strongly bulged.

This influence will presumably show even more in using copper or lead as bulging medium. Owing to their relatively high density they should lead to respectively lower lateral accelerations at even shorter bulged projectile lengths.

In addition to the aforementioned projectile and target parameters, the speed with which the plastic deformation progresses in a material, but which should not be confused with the speed of sound which usually expands with a speed of several km/s, plays an important role in the axial progression of the fragmentation. This speed range extends from a few 100 m/s up to the magnitude of 1 km/s and thus lies considerably below the speed of sound of the respective materials.

The processes in undammed cylindrical bodies during the dynamic bulging are discussed in detail and described analytically in the aforementioned doctoral thesis by G. Weihrauch on page 25 ff on the basis of copper as an example. The contexts outlined there only apply for freely bulging bodies, i.e. without lateral damming. They can therefore only be used for principal considerations in connection with the arrangements as proposed herein. In particular, the lateral damming of the bulging medium by the ambient material has a decisive influence both with respect to the lateral as well as the axial deformation speed of the bulging medium.

Accordingly, any lateral damming can thus help to achieve, which is also confirmed by the present experimental results, that even at relatively low projectile speeds in the magnitude of 1000 m/s the plastic deformation in the bulging medium progresses in aluminium, glass fibre reinforced plastic material and in particular polyethylene and nylon with relatively high axial speed, which means that it no longer primarily remains limited to the forward projectile zone (cf. FIG. 11 and FIG. 17 in particular).

A comparison of the exemplary chosen materials for the formation of a bulging zone even in lighter target structures makes clear that there is a plurality of materials which meet the aforementioned requirements not only in respect of the aforementioned considerations, but that the properties of the bulging medium can be changed within wide margins. Moreover, the comparably few examined materials that have been examined to date show that the lateral effects are adjustable and controllable by way of the behaviour of the bulging medium under dynamic compression.

The experiments also prove that not the special property of pure glass under dynamic load, but the considerations on which this invention is based are relevant for the formation of a bulging zone.

Ductile materials with higher density (such as soft iron, armco iron, lead, copper, tantalum, or even also heavy metal additions) open up the possibility to use such bulging mediums in cases when higher mean densities of the projectiles are required or when certain constructional demands such as extraballistical demands with respect to the center-of-mass position have to be fulfilled.

FIG. 12 to FIG. 15 show the respective splinter distributions of the experiments pursuant to FIG. 8 to FIG. 11 on the second target plate 3*a*. The small craters in the outermost zone 11*a* (FIG. 5) which were formed by the extracted target plate splinters 7*b* were not taken into consideration.

Figure 12:
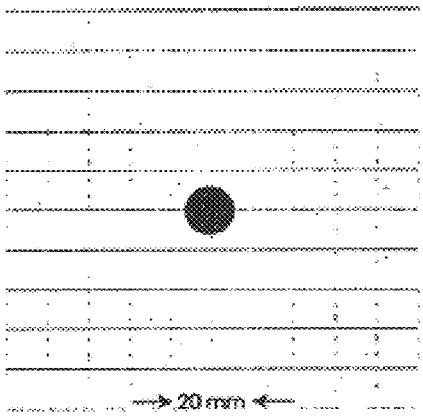
FIG. 12 shows the crater, represented on a grid, of the reference experiment (FIG. 8) with a hollow penetrator without bulging medium.

FIG. 12 shows the crater of the reference experiment (FIG. 8) with a hollow penetrator. It shows the effect of the introduced bulging medium in a comparison with the FIG. 13 to FIG. 15. The crater diameter is approx. 11 mm, and thus lies in the magnitude of two projectile diameters.

Figure 13:
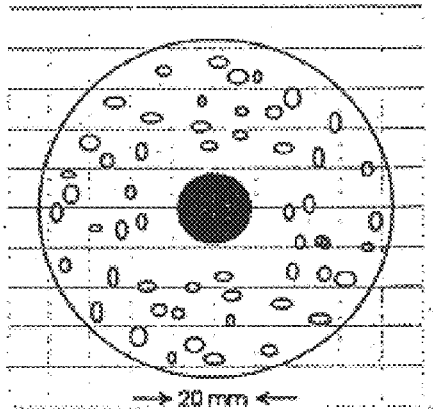
FIG. 13 shows the splinter picture, represented on a grid, of the experiment with glass fibre reinforced plastic material pursuant to FIG. 9 as a bulging medium.

FIG. 13, as a splinter image of the experiment (FIG. 9) with glass fibre reinforced plastic material as bulging medium 1, shows analogously to the description pursuant to FIG. 4 on the second plate 3*a*, which is located 80 mm away, a relatively even outer distribution 11 of the splinters 5*d* (diameter approx. 90 mm corresponding to 15 projectile diameters) formed from the casing 2, in addition to a considerably enlarged central crater zone 10, 10*a* in the magnitude of four projectile diameters.

Figure 14:
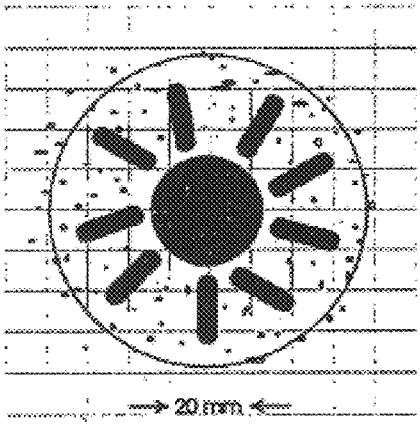
FIG. 14 shows the splinter picture, represented on a grid, of the experiment with aluminium pursuant to FIG. 10 as a bulging medium.

FIG. 14 shows the highly interesting crater image to be expected according to FIG. 10, with aluminium as bulging medium. The large central crater (diameter of approx. 5 projectile diameters) is enclosed by a circle of longitudinal subcraters (diameter of approx. 10 projectile diameters). The other splinters are distributed in a ring of approx. 13 projectile diameters.

Figure 15:
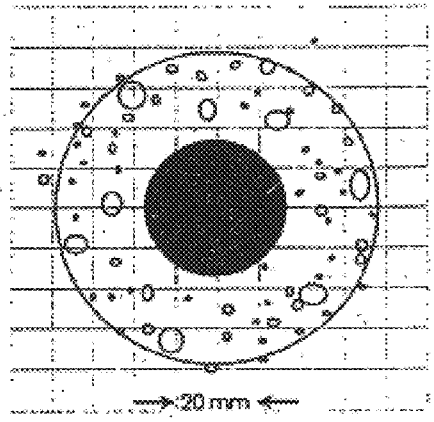
FIG. 15 shows the splinter picture, represented on a grid, of the experiment with PE pursuant to FIG. 11 as a bulging medium.

In FIG. 15 (corresponding to FIG. 11), with PE as bulging medium, the formed subprojectiles produced a relatively large inner crater diameter (approx. six projectile diameters) which is enclosed by a mixed splinter ring with a diameter of approx. 13 projectile diameters.

Principally, the penetration depth decreases in line with the lateral expansion of the splinters. Here too the known laws of terminal ballistics naturally also apply, so that the totally formed crater volume corresponds in a first approximation to the projectile energy introduced in the target.

In order to prove the high lateral effects with arrangements pursuant to this invention, two further experimental studies as proposed and performed by the ISL are mentioned below. It was intended to test first whether in the case of a considerably thinner first plate (6 mm as compared with the previous 12 mm of duraluminium) the lateral effect would still occur with the same projectile dimensions according to FIG. 6 (bulging medium: glass fibre reinforced plastic material). This is confirmed by the X-ray flash photographs in FIG. 16. According to the prerequisites as chosen herein, the projectile still opens very favourably during the passage through the first plate, but only over a comparably (FIG. 9) small projectile length. Notice should be taken, however, that a further fragmentation could be influenced over wide limits both by way of the bulging medium as well as by way of the geometries.

As the dynamic properties of the bulging material which is enclosed by a terminal-ballistically effective body such as tungsten heavy metal (WS), tungsten hard metal (WC), or depleted uranium (DU) or high-strength steel, can be evidently be changed over wide limits owing to the above statements on the density and mechanical properties, the possibilities concerning the technical arrangement allow the highest range of possible applications both with respect to construction as well as material which differ considerably in their width and performance from those when using materials such as glass or ceramics.

As was already mentioned above, the combat against fixed-wing aircraft and helicopters forms an important field of application for the projectile arrangements as described herein. A purposeful and, optionally, load-dependent fragmentation of an ammunition can also prove to be very advantageous for the design of different warheads or special-purpose ammunition, right up to combatting tactical ballistic missiles. Respective arrangements can be used both for types of ammunition with large effects in the interior of light targets right up to heavily armoured vehicles as well as ships (Exocet principle). The target scenario to be combatted determines the bulging medium to be introduced and the dimensionings.

The arrangements as proposed herein are principally highly effective in the fields of application as mentioned so far. In order to secure a high lateral effect, however, it is necessary to have a puressure and bulging zone. For this purpose it is necessary that certain physical prerequisites are fulfilled in the bulging medium. Among other things, the impact shock or load must be sufficiently strong or high on impact so as to initiate the process. Moreover, the dimensions of the bulging medium and of the penetration material enclosing the same must be tuned to one another.

Within the widest of margins these prerequisites are fulfilled at the relatively high impact speeds as are required in armour-piercing (both rotation-stabilized as well as aerodynamically stabilized) projectiles or in antiaircraft projectiles for reasons of external or terminal ballistics alone. The speed range is here approximately between 800 m/s and 2000 m/s. The type and dimensioning of the bulging medium and the ambient casing or the structure of the subpenetrators primarily determine the desired effects.

At even higher speeds the formation of bulging zones will certainly be even more marked, which means that the share of the bulging medium can become smaller with increasing impact speed.

In a further experiment it was intended to prove the efficiency of arrangements pursuant to FIG. 1 at considerably lower impact speeds. A target arrangement pursuant to FIG. 4 in conjunction with a projectile according to FIG. 6 was used as reference. Glass fibre reinforced plastic material pursuant to FIG. 9 was used as bulging material.

In the experiment pursuant to FIG. 17 the impact speed v in the target was only 962 m/s. The right X-ray flash photograph shows that here obviously the speed range was reached from which the lateral fragmentation is virtually just ensured with the predetermined geometrical dimensions and the materials used.

Owing to the tip pressure occurring during the impact a full lateral fragmentation was still achieved in the forward part of the projectile. The tip pressure $\rho_p{}^*C_p{}^*v$ (with $C_p$=sound of speed in the projectile material (or in the bulging material, respectively), v=impact speed and $\rho_p$=density of the projectile material (or of the bulging material, respectively)) is degraded relatively rapidly in the course of the penetration to the quasi-stationary dynamic pressure (Bernoulli pressure; $\rho_p/2{}^*u^2$ with u=penetration speed). This pressure is determinative for the formation of the following pressure and bulging zone. The pressure and bulging zone extends here over the entire remaining projectile length as a result of the lateral damming (compare the statements in connection with FIG. 11). The casing is thus fragmented in this way into several longitudinal splinters.

FIG. 17A shows the respective crater image on the second plate (distance 80 mm). The produced central crater corresponds to approx. 5 projectile diameters. The splinter cone is still very considerable with a circle of approx. 11 projectile diameters. Evidence was thus provided that the high lateral effects are still ensured at impact speeds below 1000 m/s. Moreover, the considerations made in conjunction with the confirming experiments prove that the desired lateral effects can be secured and varied over wide margins by way of the geometrical arrangement and the choice of the respective materials.

According to the considerations made so far and the findings already made up this point, it may be assumed that by choosing respective parameters it is possible to achieve a high lateral fragmentation even at much lower impact speeds. In projectiles or war-heads with relatively low impact speeds such as merely a few 100 m/s the margin is certainly limited and the dimensionings and materials must be tuned carefully with respect to one another. The fragmentation will be supported by thin-walled casings, for example.

In the case of light armourings, for example, jackets which are advantageously thin-walled and have a terminal ballistic effect and particularly suitable bulging media such as PE, glass fibre reinforced plastic material or light metals such as aluminium will be used.

It is also possible to strongly reduce the penetration depth by means of respective dimensionings and pairings of materials such as by very thin casings in conjunction with "sensitive" bulging media and thus to design projectile with no effect or a very low effect. The use of biodegradable fibre materials as bulging medium is a particularly viable possibility. With this novel kind of very light composite materials, which were mostly developed by DLR Braunschweig, strength values can be achieved which nearly correspond to those of glass fibre reinforced plastic materials.

Such a special case of a cylindrical body with very low penetration power has already been described in the aforementioned thesis of G. Weihrauch on page 100. From the equation $\frac{1}{2}{}^*\rho_p{}^*(v-u)^2 = \frac{1}{2}{}^*\rho_z{}^*u^2+F$ for u=0 the values $F_x=\frac{1}{2}{}^*\rho_p{}^*v_x{}^2$ are derived at which no plastic penetration occurs any more. By a respective setting of the densities and strengths of the bulging medium and of the penetration tool which encompasses the same it is thus possible to prevent a penetration into the target structure nearly entirely.

A technically highly interesting application is given for this border case also when a fragmentation of the casing by way of a suitable bulging medium is to occur in such a way that in the case of special-purpose ammunition, for example, a target is to be damaged as little as possible and the projectile slides off from a target without causing any destructions there. For this purpose, however, the target plate must be sufficiently thickly dimensioned in order to avoid any piercing through. This is presumably ensured with thicknesses in the magnitude of 0.5 to 1 projectile diameters.

The range of materials as shown herein allows a very wide range of applications, particularly by also utilizing possibilities for the transmission of forces in the axial and radial direction in conjunction with a controllable fragmentation mechanism on the selection or the setting of the material for the bulging zone per se (e.g. by using plastics, light metals, fibre reinforced materials or other mixtures).

Materials such as glass fibre reinforced plastic material or other plastics play a special role from a technical point of view. As this type of material is only to be used in an exemplary manner to describe the technical advantages in the realization of the present invention, the possibilities for the arrangement of the glass fibre reinforced plastic materials by different production methods shall not be discussed in detail herein.

Only the following shall be stated as catchwords: "share of glass can be altered, types of resin, filler materials, load-oriented composites, production methods, cross linkage techniques, gluing techniques, mixing assortments, variable densities, etc.".

The temperature behaviour of glass fibre reinforced plastic material is also very favourable within the terms of the requirements. Moreover, it is known from various fields of technology that a composite of metallic materials (plates, pipes) with glass fibre reinforced components (technical glass fibre reinforced plastic material structures) leads to an overall improved stability under load, particularly in complex load situation. These occur frequently in applications in the area of ballistics.

According to the considerations made above in connection with the example of glass fibre reinforced plastic material or plastics, or even metallic components, there are considerable advantages in the application of such materials as dynamic bulging media in projectiles or war-heads. In addition to extremely favourable mechanical values, the particularly advantageous technical arrangements and connections shall be explained below in closer detail.

Apart from the circumstance that a very extensive range of materials is available as effective bodies, the possibility also arises to use prefabricated inserts, for example. Potential materials are metals with favourable plastic deformation properties such as lead or copper, materials which can be favourably worked such as light metals, materials of low density such as plastics (PE, nylon, etc.) and, naturally, primarily materials which are introduced or glued in in a mechanically favourable manner. Moreover, the bulging medium can be introduced into respective hollow chambers if provided with liquid, plastic or kneadable properties. In this respect mixtures or mechanical mixtures are of particular interest.

Principally, two directions are imaginable for the introduction into and connection of metallic materials, plastics or special-purpose materials, and in particular glass fibre reinforced plastic materials, in structural bodies which are adjacent to or dam up during the impact or penetration of kinetic energy projectiles and projectile parts:

A. The introduction as prefabricated technical structure.

B. The introduction as a loose (mush-like or dry) mechanical mixture.

Concerning A:

1. Metallic materials. Other materials with similar densities and sufficient mechanical strength and low compressibility. Design of a technical structure.

2. The mentioned materials are introduced as prefabricated bodies and are glued or injection-moulded all around.

3. Combinations of 1. and 2.

Concerning B:

Injection moulding of thermoplastic and fibre-reinforced materials; castable and pressable mixtures of different materials such as elastomeric materials.

DP-RTM methods (duroplastics) for dry inserted mixtures and mechanical mixtures.

The processes according to B can naturally also be combined with the technical structures according to A.

Concerning the technical arrangement and the possibilities for the introduction of dynamically acting bulging media in projectiles and war-heads, particularly interesting variants are possible with respect to the effect such as by:

- different materials as bulging media with different specific properties;
- in the case of glass fibre reinforced plastic materials: different glass contents and resin types;
- different radial and/or axial arrangements of the technical structures;
- mixtures of differently acting materials (such as differences in density and strength);
- joining by sliding of prefabricated components (hollow cylinders; telescope; cone);
- placing partly differently dimensioned bodies next to one another;
- introduction of special materials with specific effects (e.g. incendiary);
- introduction of explosive materials;
- introduction of materials with different terminal ballistic effects;

The advantages in respect of the production technique for the design of projectiles and warheads with such dynamically acting components would be, among other things:

- The inner and outer bodies (penetrator, jacket, casing, inserts) can be provided with any desired surface. The special-purpose materials bridge the surface roughnesses for example (cheaper production; possibility of using components from other production);
- introduction of duroplastic or thermoplastic resins or elastomers by injection, pressure or suction;
- bridging of edges, shoulders and threads or the like;
- form-locking by way of threads;
- favourable temperature behaviour;
- shock resistance (during launching or in special target structures such as bulkhead arrangements, composite armourings, etc.);
- controllable fragmentation efficiency;
- embedding of metallic and nonmetallic bodies such as splinters, rods, cylinders, balls right up to prefabricated subprojectiles and small bodies of different shapes and materials.

The aforementioned listing shall in no way be regarded as complete.

In addition to the above statements, reference shall hereby be made to other materials than bulging media whose application can be of additional benefit within the scope of the development of new types of ammunition with high lateral effect. This relates in particular to the field of the elastomers. Rubber acts, like polyethylene, in a dynamically incompressible manner when enclosed and can produce very high forces on the walls surrounding it (hydraulic module). In the case of certain types of rubber the elasticity module changes discretely by several powers of ten under high dynamic load.

The injection method is particularly employed when using elastomers, which method creates a plane and highly durable connection to the ambient projectile bodies. Even complex types of arrangements and connections can be realized in this way in a very simple manner.

It is also possible to fill bulging media with metal powders of high density (tungsten, etc.) in order to considerably increase the mean density (e.g. glass fibre reinforced plastic material with >3 g/cm$^3$).

The use of powdery materials (metal or other powders) is also of interest as bulging media, which are introduced either as unsintered pressed powder parts in the projectile or are pressed directly into the casings in order to increase the density in the projectile or keep the penetration power low.

Members of the family of synthetic-resin-compressed wood can also be used as bulging medium. They comprise a low density and are simultaneously incompressible and react dynamically in a respective manner (such as Lignostone® with a density range of 0.75 g/cm$^3$ to 1.35 g/cm$^3$).

Additional pyrophorous effects in the target after the penetration of the outer skin can be achieved by adding respective materials (cerium or cerium mixed metals, zirconium, etc.) which can be incorporated easily in the glass fibre reinforced plastic materials or elastomer materials. The concentrated introduction or embedding of such materials is also principally possible.

The introduction of explosive materials, either as admixtures to the plastic materials or as explosive per se, can optionally lead to a controllable detonating fragmentation of the projectile body via the function as bulging medium.

The aforementioned extremely wide spectrum of possibilities for combination opens up a completely new field of design for projectiles and war-heads in conjunction with the technical applications, production aspects and special terminal-ballistically effective bodies. This wide field of innovations will lead to very interesting concepts for the widest range of types of ammunition.

The following figures are used for explaining the possibilities as discussed briefly above. In this respect, FIGS. 18 to FIG. 21 relate more to the technical advantages of the introduction of a bulging medium, whereas FIG. 22 to FIG. 30A relate more to the technical implementation of such projectiles.

Figure 18:
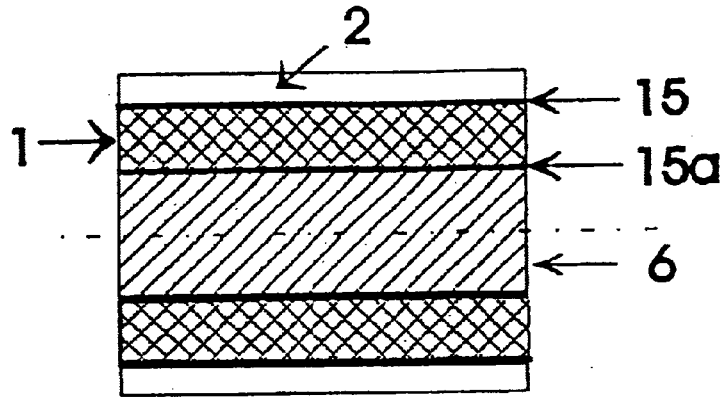
FIG. 18 shows a principal constructional proposal on the introduction of a prefabricated bulging medium body and fixing by a thread and gluing/soldering.

Accordingly, FIG. 18 shows the case where a prefabricated body is introduced as a bulging medium 1 by means of a thread 15, 15*a* between the ambient terminal-ballistically effective material 2 and a central penetrator 6. For the purpose of a stronger connection it is possible to additionally introduce a connecting layer as an adhesive or soldering layer.

Figure 19:
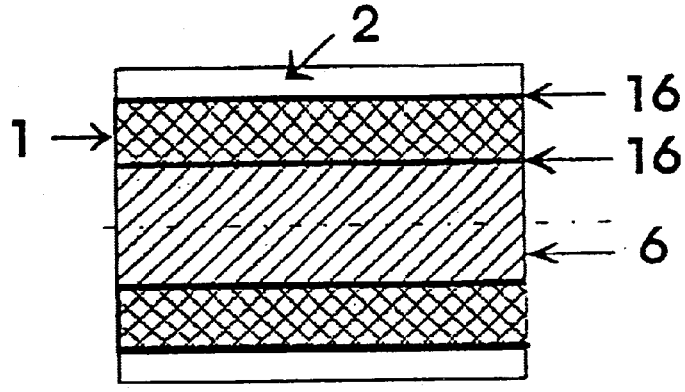
FIG. 19 shows a principal constructional proposal on the introduction of a prefabricated bulging medium body and fixing by a connecting medium.

FIG. 19 shows a prefabricated body introduced as bulging medium 1 between the ambient terminal-ballistically effective material 2 and the central penetrator 6. A connecting medium 16 is introduced in the gaps between the casing 2 and the central penetrator 6, which medium is preferably used for the transmission of forces.

Figure 20:
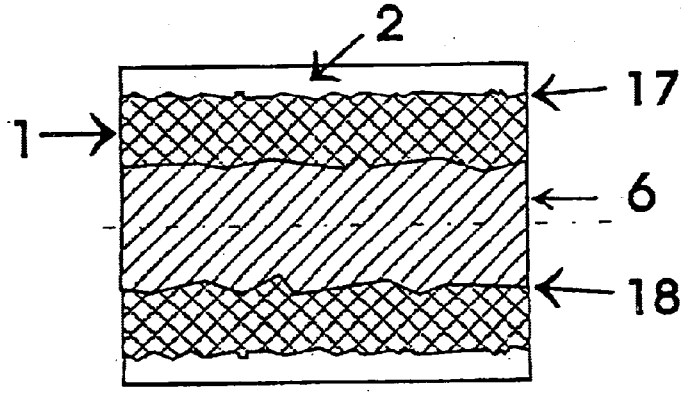
FIG. 20 shows a principal constructional proposal on the introduction and fixing of a prefabricated bulging medium body with random surface roughnesses.

FIG. 20 shows the case that both the inner surface 17 of the projectile casing 2 as well as the surface 18 of the central penetrator 6 has a random surface roughness or a surface arrangement. A bulging medium 1 that is injected for example will bridge any such unevenness and ensures in addition to a lateral effect also a perfect transmission of forces between the casing 2 and the central penetrator 6.

Figure 21:
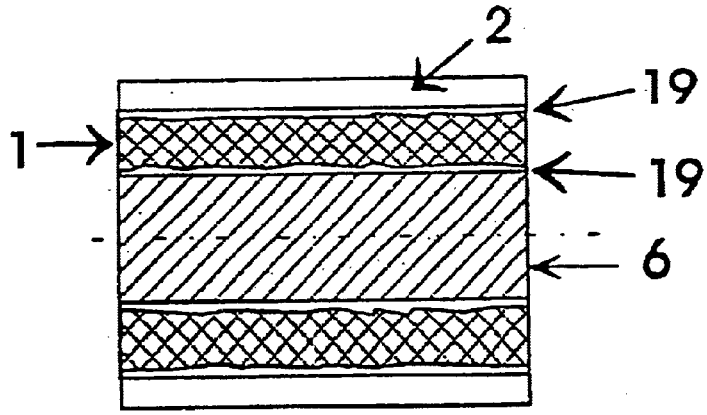
FIG. 21 shows a modified constructional proposal according to FIG. 20 concerning the introduction and fixing of a prefabricated bulging medium body.

In FIG. 21 the bulging medium 1 is introduced as a prefabricated body with uneven surfaces. Here a layer 19 with the required properties, which is comparable to the connecting medium 16, ensure the technically perfect connection between the casing 2 and the penetrator 6.

Figure 22:
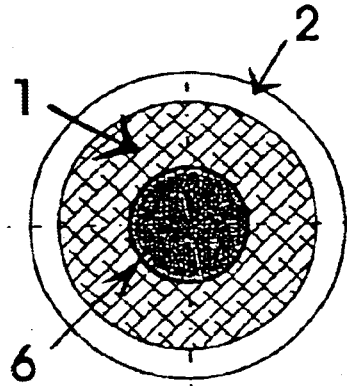
FIG. 22 shows a sectional view through a projectile with a bulging medium and a central penetrator pursuant to FIG. 2.

FIG. 22, as a reference figure for the FIG. 23 to FIG. 30A, shows a sectional view through the projectile pursuant to FIG. 2, which projectile is formed from the components of a bulging medium 1, casing 2 and partly a central penetrator 6.

Figure 23:
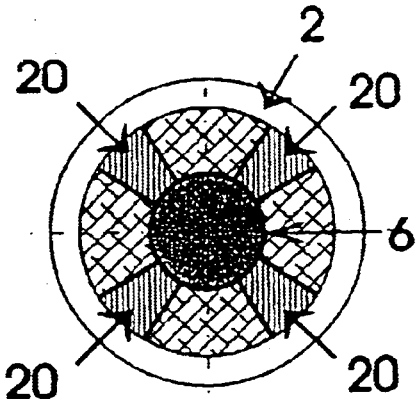
FIG. 23 shows a sectional view through a projectile with a bulging medium and a central penetrator and additional bridges as subprojectiles.

Bridges 20 as subprojectiles have been introduced in FIG. 23 between the central penetrator 6 and the outer projectile element 2. These bridges 20 of random length remain substantially excluded from the lateral acceleration. The bulging medium is used here additionally as a carrier for the subprojectiles (bridges) 20. Respectively thin bridges 20 can be used for the mere fixing of the central penetrator 6.

Figure 24:
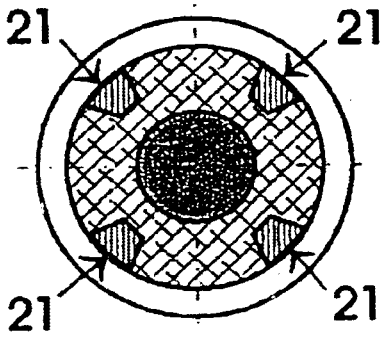
FIG. 24 shows a sectional view through a projectile with a bulging medium and a central penetrator and additional rod-shaped or successively disposed terminal-ballistically effective bodies.
Figure 24A:
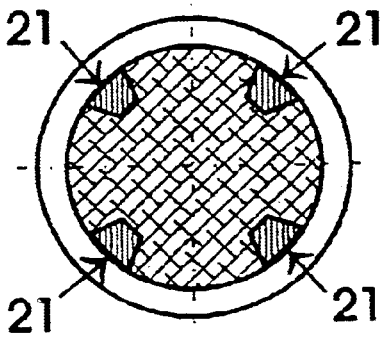
FIG. 24A shows a sectional view through a projectile with a bulging medium without a central penetrator and additional rod-shaped or successively disposed terminal-ballistically effective bodies.

In FIG. 24 either rod-like or successive bodies 21 with terminal ballistic effect are introduced into the bulging medium. They are radially co-accelerated as a result of their arrangement on the outside. In this way prefabricated subpenetrators or other effective parts can be laterally accelerated simultaneously with the enclosing body. FIG. 24A corresponds to FIG. 24 without a central penetrator.

Figure 25:
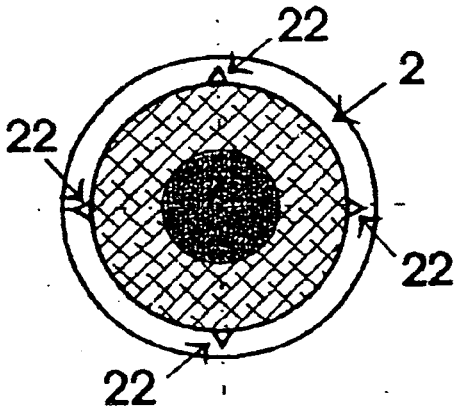
FIG. 25 shows a sectional view through a projectile with a bulging medium and a central penetrator and additional notches on the inner side of the terminal-ballistically effective outer body.

FIG. 25 shows the case that notches 22 or embrittlements are provided on the inner side of the enclosing terminal-ballistically effective body 2. They predetermine a desired fragmentation of the body 2 or support the same.

Figure 26:
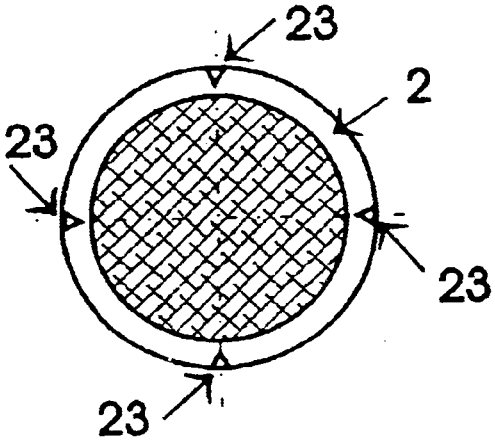
FIG. 26 shows a sectional view through a projectile with a bulging medium without a central penetrator and additional notches on the outer side of the terminal-ballistically effective outer body.

FIG. 26 shows in an exemplary manner a projectile without a central penetrator, with notches 23 or other measures benefitting the fragmentation being situated on the outer side of body 2, in contrast to FIG. 25.

Figure 27:
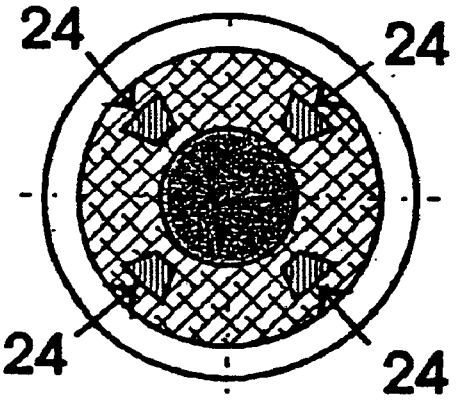
FIG. 27 shows a sectional view through a projectile with a bulging medium and a central penetrator and any other additional bodies embedded in the bulging medium and being effective in a terminal ballistic or any other manner.

In FIG. 27, random bodies 24 which are provided with terminal ballistic or other effect are embedded into the bulging medium. They are only deflected in a stronger radial manner in the case of a positioning in the outer zone by the formation of the bulging zone.

Figure 28:
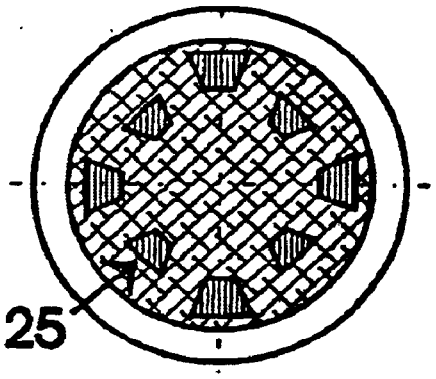
FIG. 28 shows a sectional view through a projectile with a bulging medium without central penetrator and any other additional bodies embedded in the bulging medium and being effective in a terminal ballistic or any other manner.

FIG. 28 shows the respective case without a central penetrator with a larger number of similar or different bodies 25.

Figure 29:
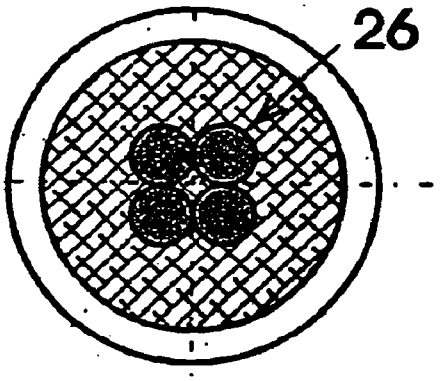
FIG. 29 shows a sectional view through a projectile with a bulging medium and four centrally arranged penetrators.

A further case which is particularly interesting for the arrangement of such projectiles is shown in FIG. 29. Four long penetrators 26 are introduced into the bulging medium in the axial zone, for example.

The above examples are to show that any other central penetrators, penetrator parts or other effective bodies can be embedded and fixed by way of the bulging medium. This also applies analogously to the case that the bodies 24 and 25 in FIGS. 27 and FIG. 28 represent splinters or penetrators.

Figure 30:
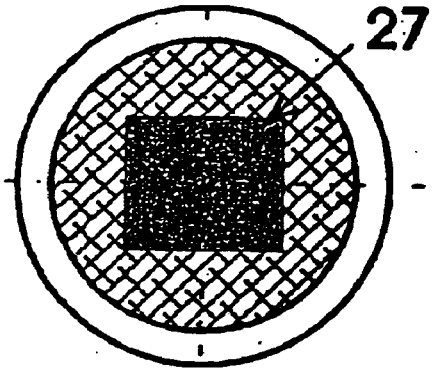
FIG. 30 shows a sectional view through a projectile with a bulging medium and a centrally arranged penetrator with a square (random) cross section.

In FIG. 30, a penetrator 27 with a square cross section is introduced as an example that the bulging medium allows embedding any desired penetrator shapes and also penetrator materials (they only have to survive the launching acceleration).

Figure 30A:
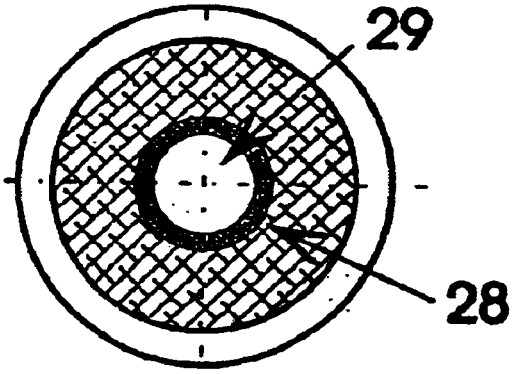
FIG. 30A shows a sectional view through a projectile with a bulging medium and a centrally arranged cylindrical penetrator with a hollow chamber.

In addition to FIG. 30, in FIG. 30A the central penetrator 28, which in this case has a cylindrical shape, is provided with a hollow chamber 29. In this way the mass of the penetrator can be reduced, for example. Such a hollow chamber can also be filled with foam or can be used for receiving materials with special properties (pyrophorous or explosive).

Moreover, the positioning of bodies in the bulging medium opens the possibility to influence the type and the scope of the lateral fragmentation or acceleration.

FIG. 31 to FIG. 34 show a number of examples with the principle as proposed herein from the large number of possible projectile designs and effective zones of projectiles.

Figure 31:
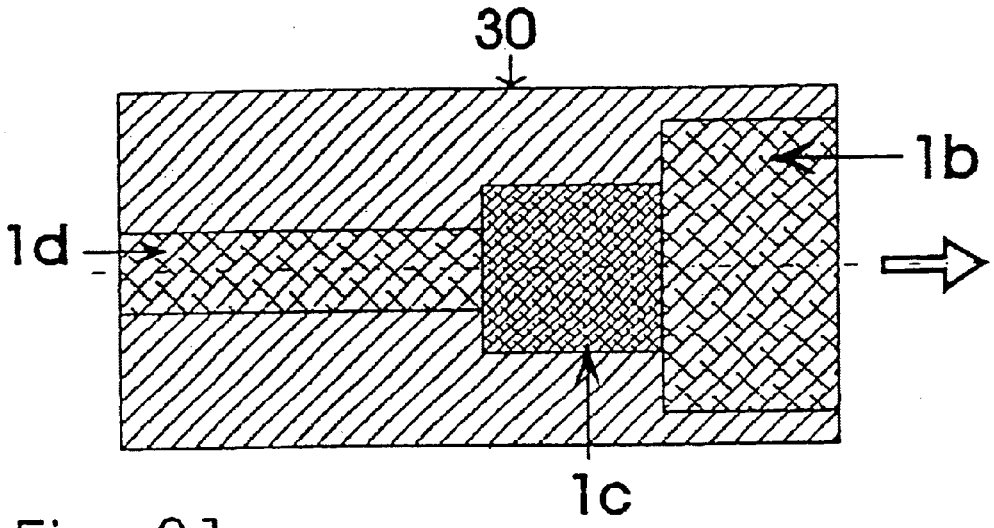
FIG. 31 shows a partial sectional view through a projectile with a graduated arrangement of the bulging medium.

FIG. 31 shows the case that the bulging medium is located in a stepped arrangement 30. Such a design, for example, reacts very "sensitively" on hitting a thin structure in the forward part, whereas the rear projectile parts form different subprojectiles or splinters owing the geometrical arrangement and also by the use of different bulging media 1*b*, 1*c* and 1*d*.

Figure 32:
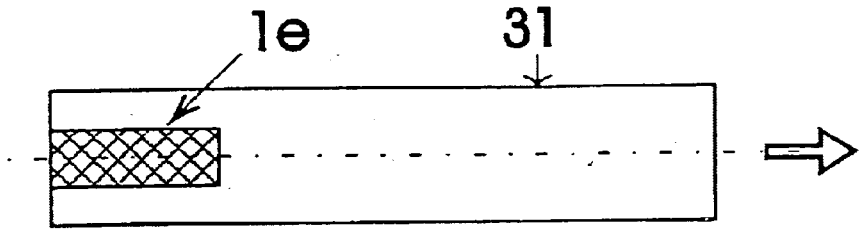
FIG. 32 shows a partial sectional view through a projectile with a partial arrangement of the bulging medium for the achievement of a high initial penetration power.

FIG. 32 shows a penetrator 31 for increasing the effect in the interior of the target after a penetration path corresponding to the forward massive projectile part. For this purpose the bulging medium 1*e* is located in the rear part of the projectile. Such a projectile 31 is capable of combining high penetration powers with large craters and respective lateral effects in the interior of the target or the following structures.

Figure 33:
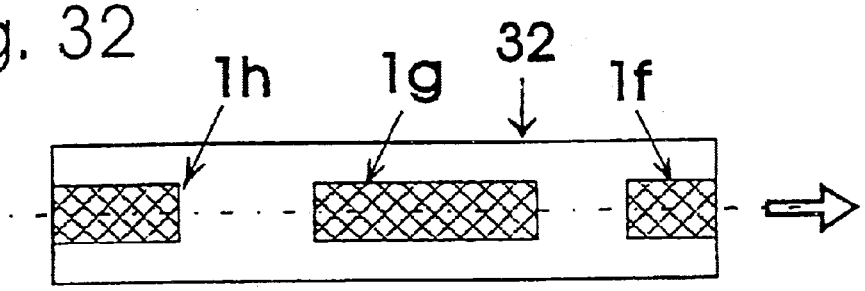
FIG. 33 shows a further partial sectional view through a projectile with three dynamic zones for the achievement of different lateral and depth effects.

FIG. 33 shows as a further example a projectile 32 with three separate dynamic zones and the bulging medium 1*f*, 1*g* and 1*h*. A projectile 32 which is arranged in such a way is capable, following a partial fragmentation in the case of the thin outer structures, of developing an increased lateral effect only after the penetration of a thicker further plate. It is followed by a massive zone for achieving a further, larger penetration path and thereafter the zone with the bulging medium 1*h* for increasing the residual effect (FIG. 32).

Figure 34:
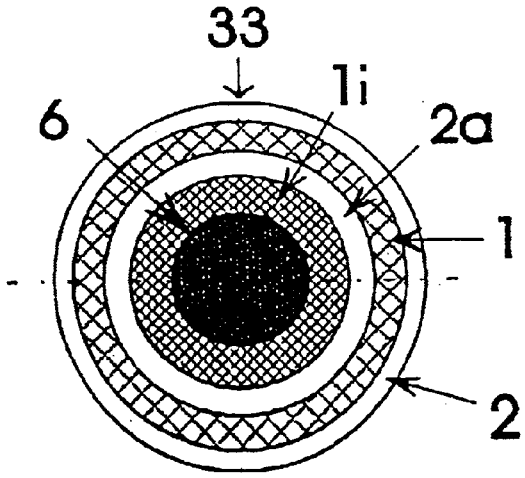
FIG. 34 shows a sectional view through a projectile with a central penetrator and two radially arranged dynamic zones for the achievement of different lateral and depth effects.

FIG. 34 shows the cross section through a projectile 33 which comprises, as an example, in the radial direction two of the effective combinations presented herein with a bulging medium 1 or 1*i* between the casings 2 and 2*a* or the casing 2*a* and the central penetrator 6. Such combinations can naturally also be arranged several times on the longitudinal axis of a projectile or be combined with the examples as mentioned above.

With the effective principle as described herein it also possible to equip projectiles which contain constructionally predetermined, enclosing bodies with terminal ballistic effect. FIG. 35A to FIG. 35D show four examples which also apply analogously for projectiles with an additional central penetrator.

Figure 35A:
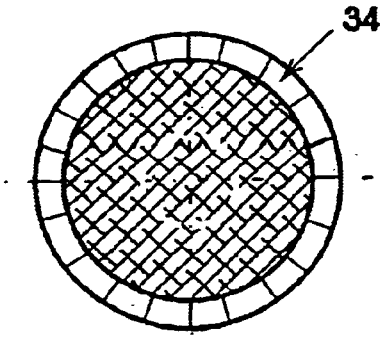
FIG. 35A shows a sectional view through a projectile with a bulging medium without a central penetrator and an outer casing made from a ring of longitudinal structures.

In FIG. 35A the outer casing 34 which dams up the bulging medium consists of a ring of longitudinal structures. They are either mechanically solidly connected with one another, e.g. also by thin sleeves, or glued or soldered together. It is also possible to treat the casing by a respective treatment such as inductive hardening or laser embrittling in such a way that the same is fragmented into predetermined bodies under dynamic load.

Figure 35B:
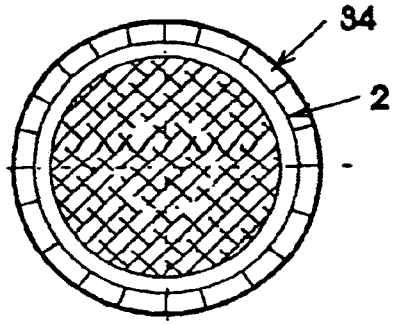
FIG. 35B shows a sectional view through a projectile with a bulging medium without a central penetrator and two different outer casings.
Figure 35C:
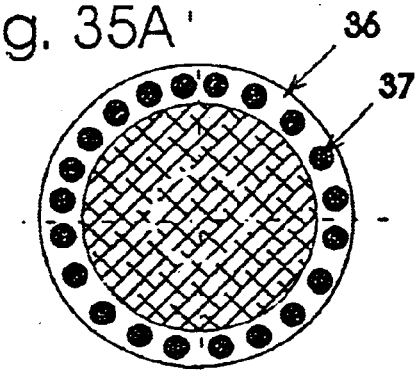
FIG. 35C shows a sectional view through a projectile with a bulging medium without a central penetrator and an outer casing in which random bodies are embedded.
Figure 35D:
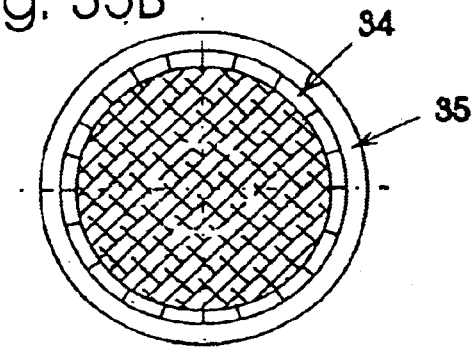
FIG. 35D shows a sectional view through a projectile with a bulging medium without a central penetrator and a ring of subpenetrators on the inner side of the outer casing.

FIG. 35B shows the case that a casing damming the bulging medium, which corresponds to casing 2 of FIG. 22, is encompassed by an outer casing 34 according to FIG. 35A. In FIG. 35C random bodies 37 are embedded in the casing 36. In FIG. 35D a ring of subpenetrators or splinters 34 is located on the inner side of the outer casing 35, corresponding to FIG. 35B.

A further element which is important for the efficiency of a projectile is the projectile tip. Below, a number of principal examples are shown (hollow tip, massive tip and special forms of tips), with the arrangement of the tips principally considering the full effectiveness of the principle as described herein, which means that it does not negatively influence the same or supplements it in a positive way.

Figure 36:
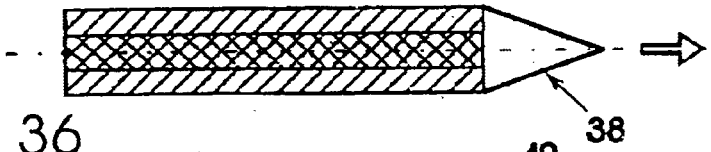
FIG. 36 shows a projectile with a bulging medium and a hollow tip.
Figure 37:
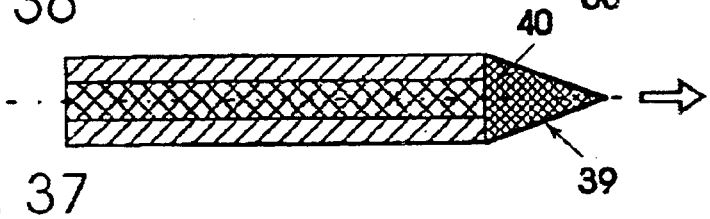
FIG. 37 shows a projectile with a bulging medium and a tip filled with a bulging medium.
Figure 38:
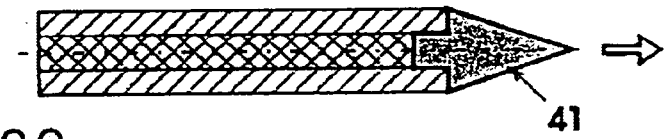
FIG. 38 shows a projectile with a bulging medium and a massive tip.

FIG. 36 shows an example for hollow tips 38. They are used primarily as extraballistic hoods and are immediately destroyed on impacting even light structures, so that the lateral acceleration process can be initiated immediately by the impact shock, as was already described. FIG. 37 shows a tip 39 according to FIG. 36, filled with a bulging medium 40. FIG. 38 shows a massive tip 41. It can be of one or several parts and is used in cases where more massive preliminary armourings are to be penetrated without any immediate fragmentation of the projectile.

Figure 39A:
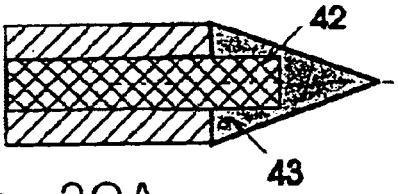
FIG. 39A shows a special shape of the tip in which the bulging medium reaches into the tip.
Figure 39B:
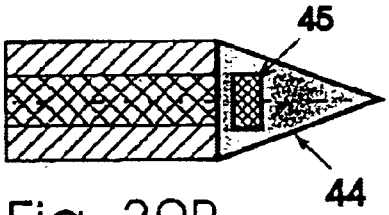
FIG. 39B shows a special shape of the tip which in partial zones contains the bulging medium.

FIG. 39A and FIG. 39B are used as examples for special forms of tips. In FIG. 39A the bulging medium 42 reaches into the tip 43. In FIG. 39B the tip 44 comprises a bulging medium 45 in partial zones. By way of the arrangement, design or selection of material of the respective tip or the forward part it is possible to start the initiation of a high lateral effect both in an accelerated manner (by a particular rapid transmission of the shock load and thus rapid buildup of pressure) as well as in a delayed manner. This is of interest, for example, when the lateral splintering effect is to occur at a specific target depth or in a specific target region.

It is also possible by means of a forward or lateral (outer) "protective apparatus" to bring superstructures with the described lateral effect to the desired location in a target structure, so that this effect will truly become effective only at such a location. Such a protective casing can also form a hollow chamber between the outer casing and the arrangement for the achievement of the lateral effect. Similarly, the protection can be formed by a buffering material which forms the outer casing either by itself or is introduced in the aforementioned hollow chamber. Such a protective casing can be of particular interest in war-heads, because with their help it is possible to introduce individual or a plurality of apparatuses for achieving a high lateral effect into the interior of a hardened or unhardened war-head and will thus allow the effect to spread only there.

By the equipment of a war-head with the devices as described herein it may also be desirable-to achieve different lateral effects and/or depth effects by mixing different bodies. This can occur in such a way for example, that respective cylinders with different geometries or wall thicknesses or casing materials are provided with different bulging material fillings.

A further technically very interesting application of the lateral concept as outlined herein may be obtained when ammunition bodies or war-heads are to be converted or disposed of. It may be of economic interest to change from a too expensive or too ineffectual concept to a novel technology. Thus it is imaginable that parts of the ammunition are removed and replaced by bodies with the high lateral effect as described herein. It is also possible to press in a plastically deformable body or to introduce the same by way of casting into a predetermined projectile (with or without inner parts) in such a way that the lateral effect as described herein can occur in the now modified projectile.

It is also imaginable to replace pyrotechnical apparatuses in projectiles or war-heads by inert materials (bulging materials) or, to the extent as is permitted by the safety regulations, to embed the same partly or entirely in these in order to obtain inert effective bodies with high lateral effects. Such reconfigured ammunition bodies or war-heads can then be used according to the altered effect for new purposes or be used as exercising ammunition.

The lateral principle as described herein can be used:

for fighting missiles and war-heads (TBM);

as effective or partial component in war-heads and missiles.

In combatting war-heads, and TBM's in particular, one can assume very high impact speeds. This not only supports the build-up of a pressure field and thus the initiation of high lateral effects, but the share of the effective bulging medium mass required for the effect is reduced accordingly. In all other respects the laws apply in combatting hardened or unhardened war-heads which have already been discussed in the description of the lateral effect against different targets.

If the principle as described herein is used in missiles, ejection bodies (subammunitions) and war-heads of guided or unguided missiles, either the body can be arranged according to the concept as proposed herein or it is used as a vessel for one or several apparatuses for producing high lateral effects.

While the invention has been illustrated and described as embodied in a projectile or war-head, it is not intended to be limited to the details shown since various modifications and structural changes may be made without departing in any way from the spirit of the present invention.

What is claimed as new and desired to be protected by letters patent is set forth in the appended claims:

1. A projectile with lateral bulging effect for combating armored targets, said projective consisting of:

a hollow cylindrical open-ended tubularly-shaped casing, said casing having a constant uniform diameter and wall thickness along the axial extent thereof and being constituted of a material selected from the group of materials consisting of tungsten heavy metal; tungsten hardened metal; depleted uranium and high strength steel; a mass consisting of a bulging medium filling the interior of said hollow cylindrical tubularly-shaped casing and constituting an effective active charge, said casing and said bulging medium having an open leading ends terminating in a flat impact surface extending perpendicularly of the longitudinal axis of said casing for impacting a target in surface contact, said bulging medium being selected from the group of materials consisting of glass-fiber reinforced plastic, polyethylene, nylon, aluminum, copper, lead, tantalum, synthetic resin-containing compressed wood and composites constituted of plastics and metal excluding iron and steel and being of a density and strength which is lower than the density and strength of the material of the casing, wherein the material of said casing upon impacting a target is ballistically more effective than the material of the effective active charge, such that upon the projectile impacting against the target, the bulging medium is axially retarded and thereby compressed within a compression zone proximate said leading of the casing and so as to laterally bulge and impact a radially outward deflection to at least the leading end of the casing penetrating into the target.

2. The projectile as claimed in claim 1, wherein the hollow tubular casing has a length of approximately 40 mm, an outer diameter of approximately 6 mm and an inner diameter of approximately 3.5 mm.

3. The projectile as claimed in claim 1, wherein the bulging medium filling the interior of said casing incorporates pyrophorous additives.

4. The projectile as claimed in claim 3, wherein said pyrophorous additives are selected from the group of materials consisting of cerium and zirconium.

* * * * *